US010843026B2

(12) United States Patent
Davis

(10) Patent No.: US 10,843,026 B2
(45) **Date of Patent: *Nov. 24, 2020**

(54) EXERCISE SYSTEM AND KIT

(71) Applicant: B and A Health and Fitness, LLC, Moorestown, NJ (US)

(72) Inventor: Ross Davis, Palmyra, NJ (US)

(73) Assignee: B AND A HEALTH AND FITNESS, LLC, Moorestown, NJ (US)

( * ) Notice: Subject to any disclaimer, the term of this patent is extended or adjusted under 35 U.S.C. 154(b) by 70 days.

This patent is subject to a terminal disclaimer.

(21) Appl. No.: 16/041,931

(22) Filed: Jul. 23, 2018

(65) Prior Publication Data

US 2018/0326245 A1 Nov. 15, 2018

Related U.S. Application Data

(63) Continuation-in-part of application No. 15/147,535, filed on May 5, 2016, now Pat. No. 10,029,137, (Continued)

(51) Int. Cl.
*A63B 21/04* (2006.01)
*A63B 21/055* (2006.01)
(Continued)

(52) U.S. Cl.
CPC ..... *A63B 21/0407* (2013.01); *A63B 21/0004* (2013.01); *A63B 21/00065* (2013.01); (Continued)

(58) Field of Classification Search
CPC ..... A63B 21/0004; A63B 21/00065; A63B 21/028; A63B 21/0407; A63B 21/0414; (Continued)

(56) References Cited

U.S. PATENT DOCUMENTS 2,920,418 A 1/1960 Britt
3,403,906 A 10/1968 Burzenski
(Continued)

FOREIGN PATENT DOCUMENTS

WO 9405373 3/1994
WO 2013052192 4/2013

*Primary Examiner* — Megan Anderson
(74) *Attorney, Agent, or Firm* — The Belles Group, P.C.

(57) ABSTRACT

An exercise apparatus, system, or kit that includes separate components that can be used together during a workout. In one embodiment, the exercise kit includes a hub having a monolithic body portion and sleeve portions thereon. During use, only the sleeve portions contact the surface upon which the hub is located. The hub also has an annular groove formed therein and a bore formed therethrough. The kit also includes an elongated bar that is configured to interact with the hub in multiple positions to enable user to perform difference exercises. The different positions include: (1) a first exercise position wherein the elongated bar is positioned within the bore and portions of the elongated bar protrude from the first and second ends of the monolithic body portion; and (2) a second exercise position wherein the elongated bar is positioned within the annular groove.

20 Claims, 23 Drawing Sheets

Related U.S. Application Data which is a continuation of application No. 14/286,085, filed on May 23, 2014, now Pat. No. 9,352,184.

(60) Provisional application No. 61/826,856, filed on May 23, 2013.

(51) Int. Cl.

| | |
|---|---|
| ***A63B 21/00*** | (2006.01) |
| ***A63B 23/12*** | (2006.01) |
| ***A63B 23/035*** | (2006.01) |
| ***A63B 23/02*** | (2006.01) |
| ***A63B 21/068*** | (2006.01) |
| ***A63B 21/02*** | (2006.01) |
| ***A63B 71/00*** | (2006.01) |
| *A63B 23/00* | (2006.01) |

(52) U.S. Cl.

CPC ..... *A63B 21/028* (2013.01); *A63B 21/0414* (2013.01); *A63B 21/0552* (2013.01); *A63B 21/0555* (2013.01); *A63B 21/0557* (2013.01); *A63B 21/068* (2013.01); *A63B 23/0211* (2013.01); *A63B 23/0355* (2013.01); *A63B 23/03508* (2013.01); *A63B 23/03525* (2013.01); *A63B 23/1236* (2013.01); *A63B 23/1281* (2013.01); *A63B 71/0036* (2013.01); *A63B 2023/006* (2013.01); *A63B 2210/50* (2013.01)

(58) Field of Classification Search

CPC ..... A63B 21/0552; A63B 21/0555; A63B 21/0557; A63B 21/068; A63B 21/4035; A63B 21/4049; A63B 23/0211; A63B 23/03525; A63B 23/0355; A63B 23/1236; A63B 23/1281; A63B 71/0036; A63B 2210/50

See application file for complete search history.

(56) References Cited

U.S. PATENT DOCUMENTS

| | | | | |
|---|---|---|---|---|
| 3,616,794 | A | 11/1971 | Gromala | |
| D224,935 | S | 10/1972 | Winger | |
| 3,752,475 | A | 8/1973 | Ott | |
| 3,847,144 | A | 11/1974 | Wright | |
| 4,712,539 | A | 12/1987 | Kim | |
| 5,261,866 | A | 11/1993 | Mattox | |
| 5,312,309 | A | 5/1994 | Fox | |
| D350,796 | S | 9/1994 | Pravitz | |
| 5,577,995 | A | 11/1996 | Walker et al. | |
| D403,384 | S | 12/1998 | Clark et al. | |
| D442,653 | S | 5/2001 | Panes | |
| D445,852 | S | 7/2001 | Mishan et al. | |
| D448,851 | S | 10/2001 | Louis | |
| D451,971 | S | 12/2001 | Mitchell | |
| D454,929 | S | 3/2002 | Huang | |
| D456,051 | S | 4/2002 | Mitchell | |
| D476,706 | S | 7/2003 | Albright | |
| 7,175,573 | B1 | 2/2007 | Huang | |
| D538,360 | S | 3/2007 | Beaupre | |
| 7,250,032 | B2 | 7/2007 | Fink | |
| 7,285,080 | B1 | 10/2007 | Chiu | |
| D563,557 | S | 3/2008 | Fink | |
| D567,951 | S | 4/2008 | Fink | |
| D567,953 | S | 4/2008 | Fink | |
| 7,837,603 | B1 | 11/2010 | Carnell, Sr. | |
| D666,255 | S | 8/2012 | Babchinetskaya et al. | |
| 8,357,109 | B2 | 1/2013 | Destefano | |
| D679,347 | S | 4/2013 | Frederick | |
| D679,348 | S | 4/2013 | Frederick | |
| D688,756 | S | 8/2013 | Wauldron et al. | |
| D699,794 | S | 2/2014 | Wauldron et al. | |
| 9,011,303 | B2 | 4/2015 | MacColl et al. | |
| D770,578 | S | 11/2016 | Chang et al. | |
| 10,029,137 | B2 * | 7/2018 | Davis | A63B 21/068 |
| 2002/0187885 | A1 | 12/2002 | Liao | |
| 2007/0184950 | A1 | 8/2007 | Bradley | |
| 2008/0167168 | A1 | 7/2008 | Hurst | |
| 2012/0065557 | A1 | 3/2012 | Phillips | |

* cited by examiner

EXERCISE SYSTEM AND KIT

CROSS-REFERENCE TO RELATED APPLICATIONS

This application is a continuation-in-part of U.S. patent application Ser. No. 15/147,535, filed May 5, 2016, which is a continuation of U.S. patent application Ser. No. 14/286,085, filed May 23, 2014, now U.S. Pat. No. 9,352,184, which in turn claims priority to U.S. Provisional Patent Application Ser. No. 61/826,856, filed May 23, 2013, the entireties of which are incorporated herein by reference.

FIELD OF THE INVENTION

The present invention relates generally to an exercise system or kit that includes several components that can be utilized together to achieve a desired workout regimen.

BACKGROUND OF THE INVENTION

There is a growing emphasis on exercise and working out in order to maintain a level of fitness that is both healthy and acceptable. With the rising levels of obesity, diabetes, heart disease, and other medical issues that arise from lack of fitness and unhealthy body weights, many people are searching for better ways to achieve a workout. While having a gym membership can be beneficial, it can also be expensive and time consuming. People have begun to find alternatives to gym membership, such as working out alongside a video in the home. However, even working out alongside a video requires that a user have weights, mats, and other equipment that can be expensive and space consuming. Furthermore, workout videos require access to a television and possibly also a DVD player or other similar device, which is not always available particularly during travel.

Thus, a need exists for an exercise system or kit that facilitates the performance of one or more exercises in the home or elsewhere, that is easily portable, and that enables a user to achieve a full body workout.

BRIEF SUMMARY OF THE INVENTION

The present invention is directed to an exercise system or kit that includes separate components that can be used together during a workout. In one embodiment, the exercise system includes a hub having a monolithic body portion and a sleeve portion covering parts of the monolithic body portion. The monolithic body portion may have an annular groove formed therein as well as a bore extending therethrough. The system may also include an elongated bar. The elongated bar may interact with the hub in different positions to enable a user to perform different exercises. For example, the elongated bar may extend through the bore to enable a user to perform a first set of exercises and the elongated bar may rest on the annular groove to enable a user to perform a second set of exercises.

In one aspect, the invention can be an exercise kit comprising: a hub comprising: a monolithic body portion extending from a first end to a second end along a first longitudinal axis, the monolithic body portion comprising: an annular groove located between the first and second ends; and a bore extending from the first end to the second end; an elongated bar extending along a second longitudinal axis and configured to interact with the hub in multiple positions to enable a user to perform different exercises, the multiple positions comprising: (1) a first exercise position wherein the elongated bar is positioned within the bore and portions of the elongated bar protrude from the first and second ends of the monolithic body portion; and (2) a second exercise position wherein the elongated bar is positioned within the annular groove; and wherein the elongated bar is movable relative to the hub in a direction of the second longitudinal axis in both of the first and second exercise positions.

In another aspect, the invention can be an exercise kit comprising: a hub comprising: a monolithic body portion extending from a first end to a second end along a first longitudinal axis, the monolithic body portion formed of a rigid material and comprising: an annular groove located between the first and second ends; and a bore extending from the first end to the second end; and a first sleeve portion covering a first portion of the monolithic body portion to form a first end portion of the hub and a second sleeve portion spaced apart from the first sleeve portion and covering a second portion of the monolithic body portion to form a second end portion of the hub, the first and second sleeve portions formed of a resilient material; and an elongated bar configured to interact with the hub in multiple positions to enable a user to perform different exercises, the multiple positions comprising: (1) a first exercise position wherein the elongated bar is positioned within the bore; and (2) a second exercise position wherein the elongated bar is positioned within the annular groove.

In yet another aspect, the invention can be an exercise kit comprising: a hub comprising: a body portion extending from a first end to a second end along a first longitudinal axis, the body portion comprising; a bore extending from the first end to the second end; an annular groove having a first length; a first axial portion extending from the annular groove to the first end and having a second length; and a second axial portion extending from the annular groove to the second end and having a third length, each of the second and third lengths being greater than the first length; an elongated bar alterable between: (1) a first exercise position wherein the elongated bar is positioned within the bore with portions of the elongated bar protruding from the first and second ends of the body portion; and (2) a second exercise position wherein the elongated bar is positioned within the annular groove.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
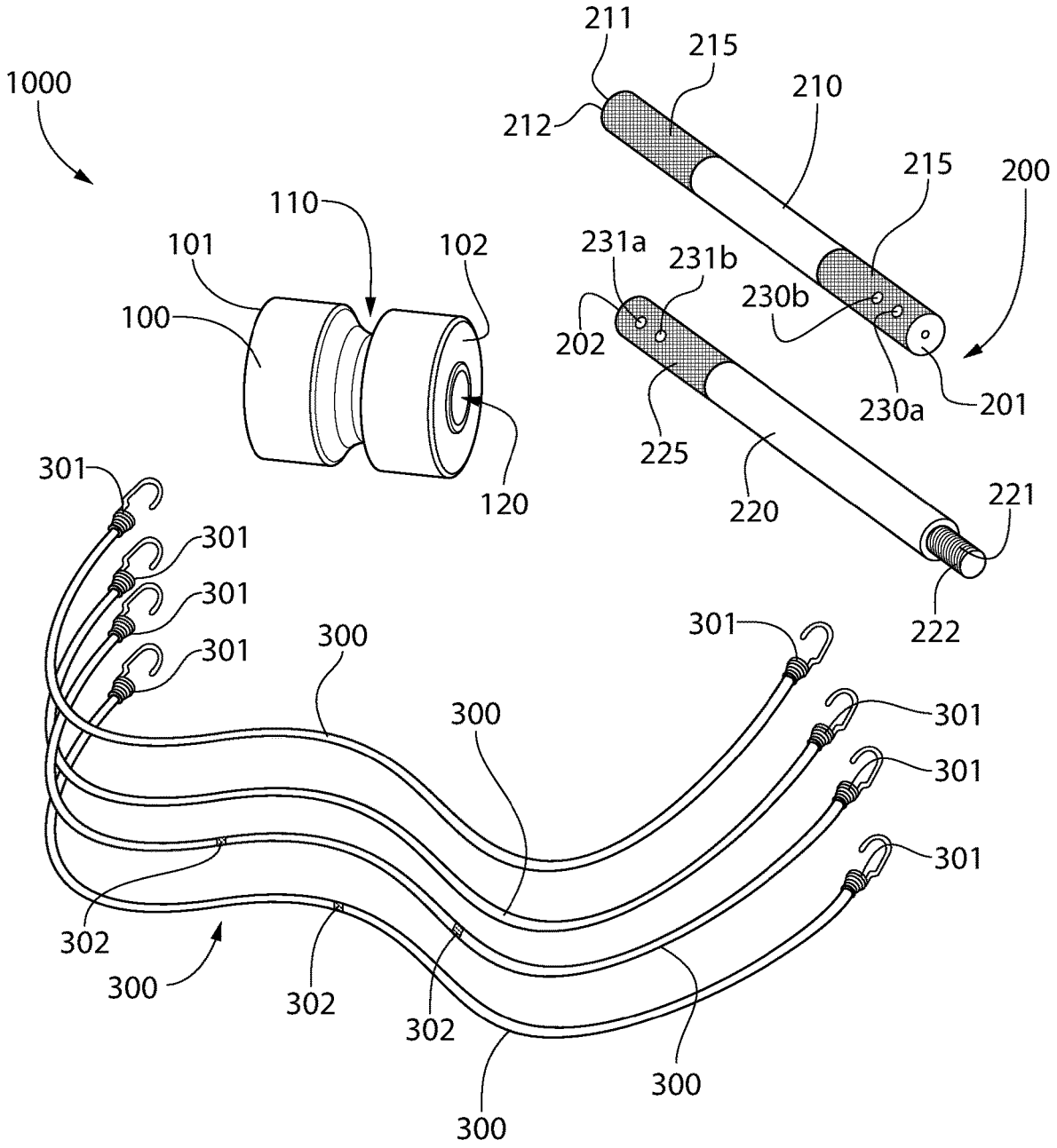
FIG. 1 is an illustration of an exercise kit in accordance with an embodiment of the present invention, the exercise kit including a cylindrical body, an elongated bar, and one or more resistance bands.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls. Furthermore, although ranges are given for some dimensions of the various components described herein, it is possible to construct the components with sizes that are outside of the provided ranges and thus the invention is not limited to those ranges in all embodiments.

Multiple embodiments of an exercise system or kit are described herein. Specifically, FIGS. 1-13 relate to a first embodiment of an exercise system or kit 1000 and FIGS. 14-27B related to a second embodiment of an exercise system or kit 2000. In some instances, different terms may be used to refer to similar components of the exercise kits 1000, 2000. However, this does not necessarily mean that the claims are limited to one of the two embodiments if the claims utilize terms that are used to describe one embodiment but not the other. For example, in FIGS. 1-13 there is a component referred to as a cylindrical body 100, whereas in FIGS. 14-27B a component that is very similar to the cylindrical body 100 is referred to as a hub 500. However, these terms are generally interchangeable and thus use of the term "hub" in the claims may refer to the hub 500 or the cylindrical body 100 without being limited to the specific details of either unless specifically claimed as such.

Referring first to FIG. 1, an exercise system 1000 is illustrated in accordance with one embodiment of the present invention. Although described herein as being an exercise system 1000, in some embodiments the invention may be directed to an exercise kit such that the components of the system 1000 can be packaged together and sold as a kit. Furthermore, it may be possible for the components of the system 1000 to be separately packaged (or not packaged at all) and still sold as a kit. Furthermore, in some embodiments each component of the system 100 may be sold separately if desired.

The exercise system 1000 generally comprises a cylindrical body 100, an elongated bar 200, and one or more resistance bands 300. As mentioned above, the cylindrical body 100 may also be referred to herein as a hub, although throughout the description of FIGS. 1-13 it will be referred to as the cylindrical body 100. However, use of the term "hub" in the claims may encompass the cylindrical body 100 and use of the term "body portion" or "monolithic body portion" may refer to portions of the cylindrical body 100 as would be appreciated by persons skilled in the art.

The cylindrical body 100, the elongated bar 200, and the one or more resistance bands 300 can be utilized together in order to perform different workout routines. Specifically, some workout routines may require only the cylindrical body 100 and the elongated bar 200, other workout routines may require only the elongated bar 200 and the one or more resistance bands 300, and still other workout routines may require the cylindrical body 100, the elongated bar 200, and the one or more resistance bands 300. Thus, several permutations of use of the components of the system 1000 may be used to achieve a desired workout routine. As noted above, the cylindrical body 100, the elongated bar 200, and the one or more resistance bands 300 can be packaged together and sold as a kit, or they can be separately packaged and still sold together as a kit as desired. In other embodiments, the cylindrical body 100 and the elongated bar 200 may be sold together as a kit without the resistance bands 300, which can be purchased separately.

Figure 2B:
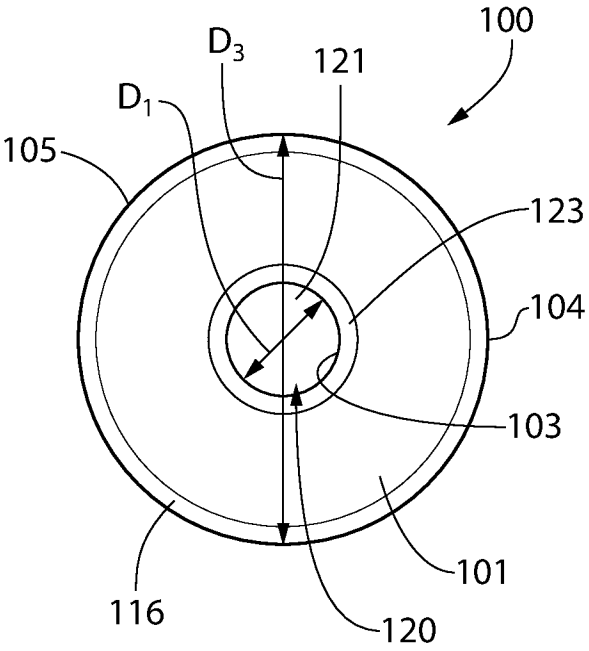
FIG. 2B is a top view of the cylindrical body of FIG. 2A.
Figure 2A:
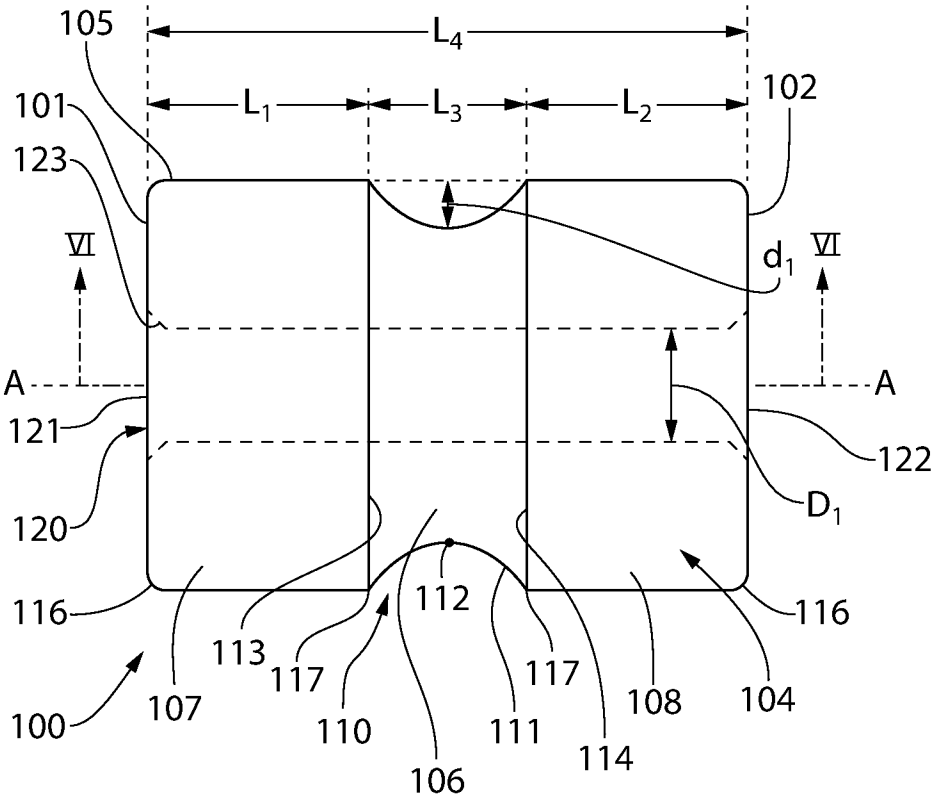
FIG. 2A is a front view of the cylindrical body of FIG. 1.

Referring to FIGS. 1, 2A, and 2B concurrently, the cylindrical body 100 of the system 1000 will be further described. The cylindrical body 100 extends from a first end 101 to a second end 102 along a longitudinal axis A-A. Conceptually, the first end 101 may be considered the top surface and the second end 102 may be considered the bottom surface or vice versa. In certain embodiments, the cylindrical body 100 has a weight in a range of 5-15 lbs., more specifically between 7-12 lbs., and still more specifically approximately 9 lbs. This light weight enables the cylindrical body 100 to be easily portable for travel. Of course, the cylindrical body 100 can have a weight that is outside of the noted ranges in other embodiments.

The cylindrical body 100 has an inner surface 103 and an outer surface 104. Furthermore, an annular groove 110 is formed into the outer surface 104 of the cylindrical body 100. The annular groove 110 extends around the entire circumference of the cylindrical body 100 and forms a reference loop about the longitudinal axis A-A such that the longitudinal axis A-A of the cylindrical body 100 intersects the center-point of the loop formed by the annular groove 110. The annular groove 110 has a first end 113 and a second end 114. Each of the first and second ends 113, 114 is an annular end portion of the annular groove 110 that defines the location on the cylindrical body 100 at which the outer surface 104 of the cylindrical body 100 begins to decrease in transverse cross-sectional area. Specifically, the first and second ends 113, 114 of the cylindrical body 100 form the transition region between the annular groove 110 of the cylindrical body 100 and the portions of the outer surface 104 of the cylindrical body 100 external to the annular groove 110.

In the exemplified embodiment, the annular groove 110 has a rounded cross-sectional profile (based on a longitudinal cross-section of the cylindrical body 100). However, the invention is not to be so limited in all embodiments and the annular groove 110 may have a square or rectangular-shaped cross-sectional profile in other embodiments. Specifically, in such an embodiment the annular groove 110 may have vertical sidewalls and a horizontal floor. In other embodiments the annular groove 110 may have a V-shaped cross-sectional profile. Thus, the invention is not to be limited by the shape of the groove 110 in all embodiments.

In the exemplified embodiment, the first and second ends 101, 102 of the cylindrical body 100 are flat, planar surfaces. Thus, the cylindrical body 100 can be positioned on a horizontal surface, such as a floor, with either of the first and second ends 101, 102 of the cylindrical body 100 in contact with the floor to maintain the cylindrical body 100 in a self-standing orientation. Alternatively, the cylindrical body 100 can be positioned on the floor with the outer surface 104 in surface contact with the floor. Due to the cylindrical shape of the cylindrical body 100, when the outer surface 104 of the cylindrical body 100 is in surface contact with the floor, the cylindrical body 100 will be able to roll along the floor, which may be desirable for specific workout routines or exercises. In certain embodiments, each of the first and second ends 101, 102 and the outer surface 104 of the cylindrical body 100 is smooth such that they have no ridges, protrusions, bumps, or the like. This will enhance the ability of the first and second ends 101, 102 of the cylindrical body 100 to maintain the cylindrical body 100 in an upright orientation and of the outer surface 104 of the cylindrical body to roll along the floor depending on the desired use of the system 1000 for a given workout routine.

The annular groove 110 conceptually divides the cylindrical body 100 into a groove portion 106, a first cylindrical portion 107, and a second cylindrical portion 108. Specifically, the first cylindrical portion 107 of the cylindrical body 100 is the portion of the cylindrical body 100 that is positioned between the first end 101 of the cylindrical body 100 and the first end 113 of the annular groove 110. The second cylindrical portion 108 of the cylindrical body 100 is the portion of the cylindrical body 100 that is positioned between the second end 102 of the cylindrical body 100 and the second end 114 of the annular groove 110. The annular groove portion 106 of the cylindrical body 100 is the portion of the cylindrical body 100 that is positioned between the first end 113 of the annular groove 110 and the second end 114 of the annular groove 110. Each of the groove portion 106, the first cylindrical portion 107, and the second cylindrical portion 108 forms a longitudinal section of the cylindrical body 100. As exemplified, each of the first and second cylindrical portions 107, 108 and the groove portion 106 of the cylindrical body 100 are formed as a single unitary structure. Thus, the first and second cylindrical portions 107, 108 of the cylindrical body 100 can not be separated from the groove portion 106 of the cylindrical body 100, but rather the cylindrical body 100 is a monolithic structure that includes each of the first and second cylindrical portions 107, 108 and the groove portion 106.

The annular groove 110 has a floor 111 that forms a portion of the outer surface 104 of the cylindrical body 100. Furthermore, the annular groove 110 has a depth $d_1$ that is measured from a lowermost point 112 of the floor 111 of the annular groove 110 to an outermost portion 105 of the outer surface 104 of the cylindrical body 100. As can be seen, the outermost portion 105 of the outer surface 104 of the cylindrical body 100 is the portion of the outer surface 104 of the cylindrical body 100 that is formed by each of the first and second cylindrical portions 107, 108 of the cylindrical body 100. In some embodiments, the depth $d_1$ of the annular groove 110 may be between 0.5 and 0.7 inches, more specifically between 0.55 and 0.65 inches, more specifically between 0.57 and 0.63 inches, and still more specifically approximately 0.6 inches. As used herein, the term approximately may include a variation, including an increase or a decrease, of up to three percent from the particular dimension or ratio provided (i.e., plus or minus three percent). This is not limited to just the dimensions provided for the depth $d_1$, but for all dimensions provided in this application. Furthermore, in certain embodiments dimensions outside of the given ranges can be used for all dimensions provided, so long as the ratios between the various dimensions are within the ranges provided herein.

In certain embodiments, the lowermost point 112 of the floor 111 of the annular groove 110 forms a center-point of the annular groove 110, the center-point of the annular groove 110 being located equidistant from the first end 113 of the annular groove 110 and the second end 114 of the annular groove 110. Furthermore, in the exemplified embodiment the annular groove 110 is centrally located between the first and second ends 101, 102 of the cylindrical body 100 such that the center-point of the annular groove 110 is equidistant from each of the first and second ends 101, 102 of the cylindrical body 100.

In the exemplified embodiment the annular groove 110 is rounded and thus the annular groove 110 has radii of curvature at various points along the annular groove 110. In some embodiments, the radius of curvature of the annular groove 110 may be constant along the entirety of the annular groove 110. In other embodiments, the radius of curvature of the annular groove 110 may change depending on the exact point on the annular groove 110 at which the radius of curvature is taken. In one embodiment, the annular groove 110 has a minimum radius of curvature of between 0.8 and 0.95 inches, more specifically between 0.83 and 0.94 inches, still more specifically between 0.845 and 0.905 inches, and still more specifically approximately 0.875 inches. As will be better understood from the description below, the radius of curvature of the annular groove 110 is specifically selected to enable the elongated bar 200 to nest within the annular groove 110, possibly in rolling contact with the floor 111 of the annular groove 110, during an exercise routine.

The first cylindrical portion 107 of the cylindrical body 100 has a first length $L_1$ that is measured from the first end 101 of the cylindrical body 100 to the first end 113 of the annular groove 110. The second cylindrical portion 108 of the cylindrical body 100 has a second length $L_2$ that is measured from the second end 102 of the cylindrical body 100 to the second end 114 of the annular groove 110. The groove portion 106 of the cylindrical body 100 has a third length $L_3$ that is measured from the first end 113 of the annular groove 110 to the second end 114 of the annular groove 110. The cylindrical body 100 has a fourth length $L_4$ that is equivalent to the first length $L_1$ plus the second length $L_2$ plus the third length $L_3$.

In certain embodiments, the first length $L_1$ is substantially equal to the second length $L_2$. Furthermore, in certain embodiments each of the first and second lengths $L_1$, $L_2$ is greater than the third length $L_3$. In one particular embodiment, each of the first and second lengths $L_1$, $L_2$ is between 1.8 and 2.5 inches, more specifically between 2.0 and 2.3 inches, and still more specifically approximately 2.15 inches. Furthermore, in one particular embodiment the third length $L_3$ is between 1.4 and 2.0 inches, more specifically between 1.55 and 1.85 inches, and still more specifically approximately 1.7 inches. The fourth length $L_4$ is between 5.0 and 7.0 inches, more specifically between 5.55 and 6.35 inches, and still more specifically approximately 6.0 inches. Furthermore, in certain embodiments a ratio of either one or both of the first and second lengths $L_1$, $L_2$ to the third length $L_3$ is between 1.15:1 and 1.65:1, more specifically between 1.2:1 and 1.3:1, and still more specifically approximately 1.25:1.

In the exemplified embodiment, the corner 116 that forms the transition from the outer surface 104 of the cylindrical body 100 to each of the first and second ends 101, 102 of the cylindrical body 100 is rounded. This prevents the cylindrical body 100 from having sharp corners which have the potential to injure a user. Of course, the invention is not to be so limited in all embodiments and sharp corners can be used in other embodiments as desired for ease of manufacture or the like. In the exemplified embodiment with the rounded corner 116, the corner 116 may have a radius of curvature that is between 0.15 and 0.22 inches, more specifically between 0.17 and 0.20 inches, and still more specifically approximately 0.1875 inches. Furthermore, the corner 117 that forms the transition from the floor 111 of the annular groove 110 to the outermost portion 105 of the outer surface 104 of the cylindrical body 100 is also rounded, although it can similarly be a sharp corner if desired. In certain exemplified embodiments, the corner 117 may have a radius of curvature that is between 0.10 and 0.15 inches, more specifically between 0.11 and 0.12 inches, and still more specifically approximately 0.125 inches.

The cylindrical body 100 also comprises a bore 120 formed therethrough. The bore 120 extends in the direction of the longitudinal axis A-A such that the longitudinal axis A-A also forms the bore axis. The bore 120 extends from a first opening 121 at the first end 101 of the cylindrical body 100 to a second opening 122 at the second end 102 of the cylindrical body 100. Thus, the bore 120 forms a passageway that extends entirely through the cylindrical body 100 from the first end 101 of the cylindrical body 100 to the second end 102 of the cylindrical body 102. The inner surface 103 of the cylindrical body 100 defines and bounds the bore 120. In the exemplified embodiment, the inner surface 103 of the cylindrical body 100 has a chamfer 123 at the first and second openings 121, 122. Specifically, in the exemplified embodiment the chamfer 123 is formed at an approximately 45° angle, although angles above and below 45° could also be used, or the chamfer may be omitted in some embodiments. Chamfering the inner surface 103 of the cylindrical body 103 facilitates insertion of the elongated bar 200 into the bore 120 when it is desired to do so for a particular workout routine as will be discussed in more detail below with reference to FIG. 4.

The bore 120 has a first diameter $D_1$. The first diameter $D_1$ may be between 1.2 and 1.7 inches, more specifically between 1.35 and 1.55 inches, and still more specifically approximately 1.428 inches. Furthermore, in certain embodiments the first diameter $D_1$ may be between 1.4 inches and 1.5 inches. In some embodiments the first diameter $D_1$ of 1.428 is the low end of the first diameter $D_1$, it being understood that this diameter may be slightly larger depending on the amount of plating that is built up on the inner surface 103 of the cylindrical body 100.

The cylindrical body 100 has an outer diameter defined herein as a third diameter $D_3$, which is measured at the outermost portion 105 of the outer surface 104 of the cylindrical body 100. In the exemplified embodiment, the third diameter $D_3$ is between 4.5 and 5.5 inches, more specifically between 4.75 and 5.25 inches, still more specifically between approximately 4.98 and 5.02 inches, and even more specifically approximately 5.0 inches. In certain instances, a ratio of the third diameter $D_3$ of the cylindrical body 100 to the first diameter $D_1$ of the bore 120 is between 3.1:1 and 3.9:1, more specifically between 3.4:1 and 3.6:1, and still more specifically approximately 3.5:1. Furthermore, in certain embodiments a ratio of the third diameter $D_3$ of the cylindrical body 100 to the depth $d_1$ of the annular groove 110 is between 7.5:1 and 9.0:1, more specifically between 8.1:1 and 8.5:1, and still more specifically approximately 8.3:1. Moreover, in certain embodiments a ratio of the first diameter $D_1$ of the bore 120 to the depth $d_1$ of the annular groove 110 is between 2.25:1 and 2.5:1, more specifically between 2.3:1 and 2.4:1, and still more specifically approximately 2.35:1.

Referring to FIGS. 2A, 2B, and 6-8 concurrently, various permutations of the materials that are used to form the cylindrical body 100 (denoted in FIGS. 6-8 as the cylindrical body 100A, 100B, 100C, respectively) will be described. The letters A, B, and C will be used as a suffix after the reference numerals to distinguish between the different embodiments depicted in FIGS. 6-8, it being understood that the description of the features provided above with the same reference numeral without the suffix is applicable. The specific structural features of the cylindrical body 100 described above are applicable to each of the cylindrical bodies 100A, 100B, 100C described in FIGS. 6-8. The cylindrical bodies 100A, 100B, 100C are only used herein to describe the different types of materials that can be used to form the cylindrical body 100.

Figure 6:
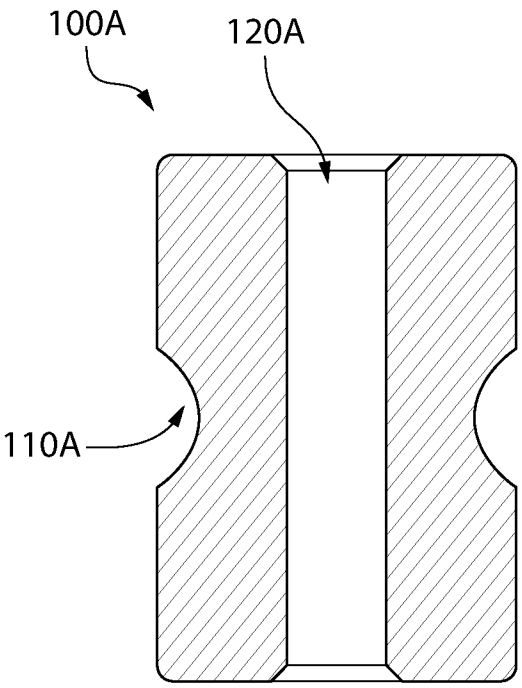
FIG. 6 is a first embodiment of a cross-sectional view taken along line VI-VI of FIG. 2A.

In FIG. 6, a first embodiment of the cylindrical body 100A is illustrated. In this embodiment, the cylindrical body 100A is formed of a single material. Specifically, in this embodiment the cylindrical body 100A is formed entirely of a metal material, such as carbon steel or the like. Thus, the bore 120A and the annular groove 110A are formed directly into the solid metal material of the cylindrical body 100A.

Figure 7:
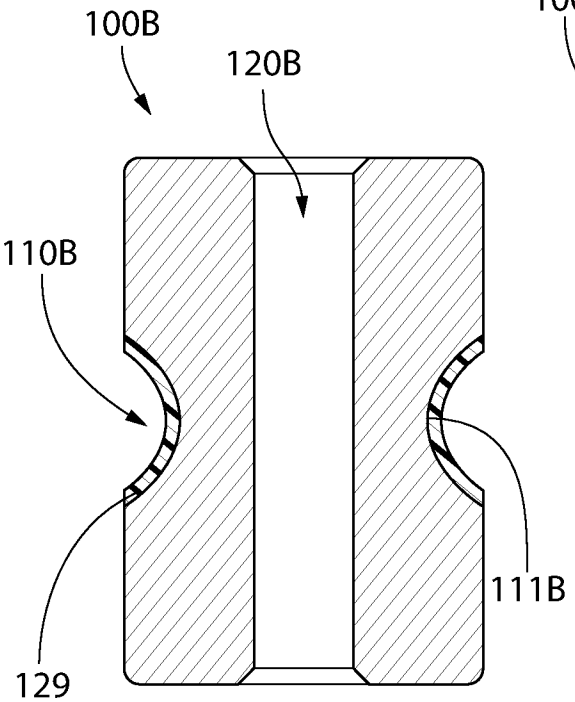
FIG. 7 is a second embodiment of a cross-sectional view taken along line VI-VI of FIG. 2A.

In FIG. 7, a second embodiment of the cylindrical body 100B is illustrated. In this embodiment, the cylindrical body 100B is formed primarily of a metal material in much the same manner as the cylindrical body 100A. Thus, the annular groove 110B and the bore 120B are formed directly into the metal material of the cylindrical body 100B. However, in this embodiment the annular groove 110B is coated or otherwise covered with a rubber overmold 129B. The rubber overmold 129B may be formed of an elastomeric material, such as a rubber like styrene-butadiene, thermoplastic elastomers, or the like. Specifically, in this embodiment the rubber overmold 129B may be molded over the floor 111B of the annular groove 110B to at least partially cover the floor 111B of the annular groove 110B. Coating or otherwise covering the floor 11B of the annular groove 110B prevents metal-on-metal contact when the elongated bar 200 is positioned within the annular groove 110B during a workout routine as discussed in more detail below with reference to FIG. 3. Specifically, in this embodiment rather than having the elongated bar 200 directly contact the metal material of the cylindrical body 100, the elongated bar 200 will contact the rubber overmold 129B, which provides a resilient contact region between the elongated bar 200 and the cylindrical body 100B and avoids the loud noise that might otherwise result from the metal-on-metal contact between the elongated bar 200 and the cylindrical body 100B.

Figure 8:
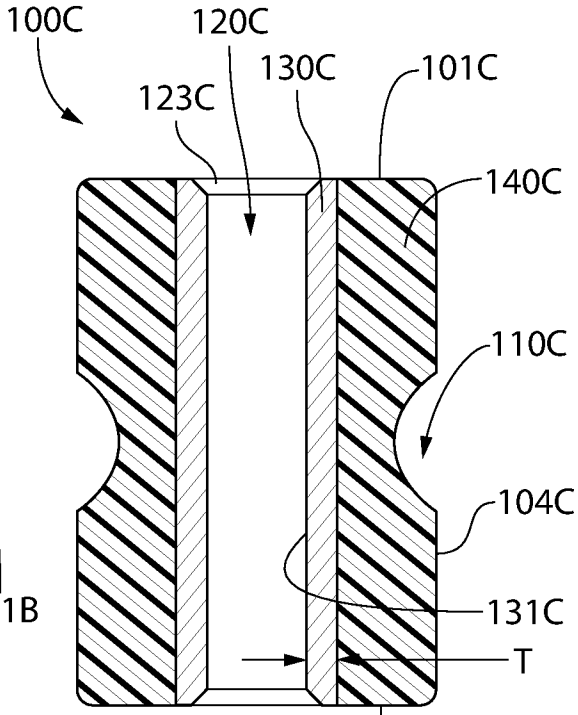
FIG. 8 is a third embodiment of a cross-sectional view taken along line VI-VI of FIG. 2A.

In FIG. 8, a third embodiment of the cylindrical body 100C is illustrated. The cylindrical body 100C comprises a tube portion 130C and an overmold portion 140C. In certain embodiments the tube portion 130C is formed of a first material having a first hardness value and the overmold portion 140C is formed of a second material having a second hardness value, the first hardness value being greater than the second hardness value. The tube portion 130C may be formed from a steel tube, such as one that is seamless by being formed using a drawn over mandrel (DOM) technique. In one exemplary embodiment, the tube portion 130C of the cylindrical body 100C is a round mechanical tube formed of carbon steel. The tube portion 130C has a length and an inner surface 131C, and it is the inner surface 131C of the tube portion 130C that defines the bore 120C. The tube portion 130C may have a thickness T of approximately 0.065 inches, although other thicknesses can be used as desired. In certain embodiments, the inner surface 131C of the tube portion 130C may be coated with hard chrome having a thickness of between 0.0005 and 0.001 inches that is smooth and free of surface imperfections. As noted above, the thickness of the hard chrome may affect the dimensions of the first diameter $D_1$ of the bore 120C.

In the exemplified embodiment, the overmold portion 140C of the cylindrical body 100C is formed of a rubber material, such as one having a Shore A durometer value of between approximately 70 and 80, and more specifically approximately 75 (similar to that which is used for outdoor roller skate or skateboard wheels). In certain exemplary embodiments, the rubber material of the overmold portion 140C of the cylindrical body 100C may be styrene-butadiene rubber (SBR). Thus, although the overmold portion 140C is formed of a rubber and is therefore somewhat resilient, due to the durometer value noted above the overmold portion 140C will still be somewhat rigid so that if the cylindrical body 100C is positioned on a horizontal surface such as a floor and is made to support a substantial amount of a user's weight, the cylindrical body 100C will not just collapse or significantly indent itself. Specifically, the rubber material is somewhat of a hard rubber so that the cylindrical body 100C will still be able to substantially maintain its shape during use.

In the exemplified embodiment, the overmold portion 140C is molded to the tube portion 130C of the cylindrical body 100C along the entirety of the length of the tube portion 130C. Thus, in the exemplified embodiment no portion of the tube portion 130C protrudes beyond the overmold portion 140C at the first and second ends 101C, 102C of the cylindrical body 100C. More specifically, in the exemplified embodiment the tube portion 130C is exactly flush with the overmold portion 140C at the first and second ends 101C, 102C of the cylindrical body 100C such that it is a combination of the ends of the tube portion 130C and the ends of the overmold portion 140C that forms the first and second ends 101C, 102C of the cylindrical body. Furthermore, as exemplified in FIG. 8, no portion of the overmold portion 140C extends into the bore 120C or into the chamfer 123C.

In this embodiment, the bore 120C is formed through the tube portion 130C as discussed above. Furthermore, in this embodiment the annular groove 110C is formed into the overmold portion 140C. Thus, because the annular groove 110C is formed from a rubber material, there is no metal-on-metal contact when the elongated bar 200 is positioned within the annular groove 110C as discussed above. Furthermore, in this embodiment the entirety of the outer surface 104C of the cylindrical body 100C is formed of a rubber material. This can be beneficial for use of the device on a hardwood floor. Specifically, during use the cylindrical body 100C is in rolling contact with a floor, which can be a carpet, a hardwood floor, tiles, vinyl or the like. When in rolling contact with a floor, the outer surface 104C of the cylindrical body 100C is in direct surface contact with the floor. Thus, forming the outer surface 104C of the cylindrical body 100C out of a rubber material will reduce the likelihood of causing damage to the floor surface upon which the cylindrical body 100C is positioned during use.

Referring now to FIGS. 1 and 9-11 concurrently, various embodiments of the elongated bar 200 will be described. First, referring to FIGS. 1 and 11, the elongated bar 200 is exemplified as a two-piece bar. Specifically, in this embodiment the elongated bar 200 comprises a first member 210 extending from a first end 201 of the elongated bar 200 to a second end 211 and a second member 220 extending from a first end 221 to a second end 202 of the elongated bar 200. In this embodiment, the second end 211 of the first member 210 comprises a first connector 212 and the first end 221 of the second member 220 comprises a second connector 222. In this embodiment, the first and second members 210, 220 of the elongated bar 200 are detachably coupled together by connecting the first connector 212 of the first member 210 to the second connector 222 of the second member 220.

In the exemplified embodiment, the first connector 212 comprises female threads and the second connector 222 comprises male threads such that the first and second members 210, 220 are threadibly couplable to one another. In other embodiments, the first connector 212 may comprise the male threads and the second connector 222 may comprise the female threads. Furthermore, in still other embodiments connection features other than threads may be used, such as fasteners, snap-fit, interference fit, keyed arrangement, protrusion/indent, or the like.

Furthermore, in the exemplified embodiment the elongated bar 200 comprises first holes 230*a*, 230*b* formed into the elongated bar 200 adjacent the first end 201 of the elongated bar 200 and second holes 231*a*, 231*b* formed into the elongated bar 200 adjacent the second end 202 of the elongated bar 200. In one embodiment the holes 230*a*, 230*b*, 231*a*, 231*b* have a diameter of approximately 0.25 inches, although other diameters can be used as desired. The elongated bar 200 extends along a longitudinal axis C-C, and at least one of the holes 230*a*, 230*b* is formed into the outer surface of the elongated bar 200 on one side of a longitudinal center-point of the elongated bar 200 and at least one of the holes 231*a*, 231*b* is formed into the outer surface of the elongated bar 200 on the opposite side of the longitudinal center-point of the elongated bar 200. In the exemplified embodiment there are two holes 230*a*, 230*b* on the first side of the elongated bar 200 and two holes 231*a*, 231*b* on the second side of the elongated bar 200, although more or less than two holes can be positioned on the opposing sides of the elongated bar 200 in other embodiments. In the exemplified embodiment, the holes 230*a*, 230*b*, 231*a*, 231*b* do not extend through the entirety of the elongated bar 200. However, in other embodiments one or more of the holes 230*a*, 230*b*, 231*a*, 231*b* may extend through the entirety of the elongated bar 200. The holes 230*a*, 230*b*, 231*a*, 231*b* are used as connectors for the resistance bands 300 as will be discussed in more detail below with reference to FIG. 5.

The first member 210 has textured regions 215 (also known in the art as knurling regions) extending from the first end 201 of the elongated bar inwardly towards a center of the first member 210 and extending from the second end 211 of the first member 210 inwardly towards a center of the first member. Furthermore, the second member 220 has a textured region 225 extending from the second end 202 of the elongated bar 200 inwardly towards a center of the second member 220. The textured regions are portions of the elongated bar 200 that has a series of protrusions that enhance the gripability of the elongated bar 200 during use. Specifically, it is common with weight lifting bars to use a knurling process to cut or roll diamond-shaped criss-cross patterns into the metal to enable a user's hands or fingers to get a better grip on the weight lifting bar than would be provided with a smooth surface. In the exemplified embodiment, each of the holes 230*a*, 230*b*, 231*a*, 231*b* is formed into one of the textured regions 215, 225 of the elongated bar 200.

Figure 4:
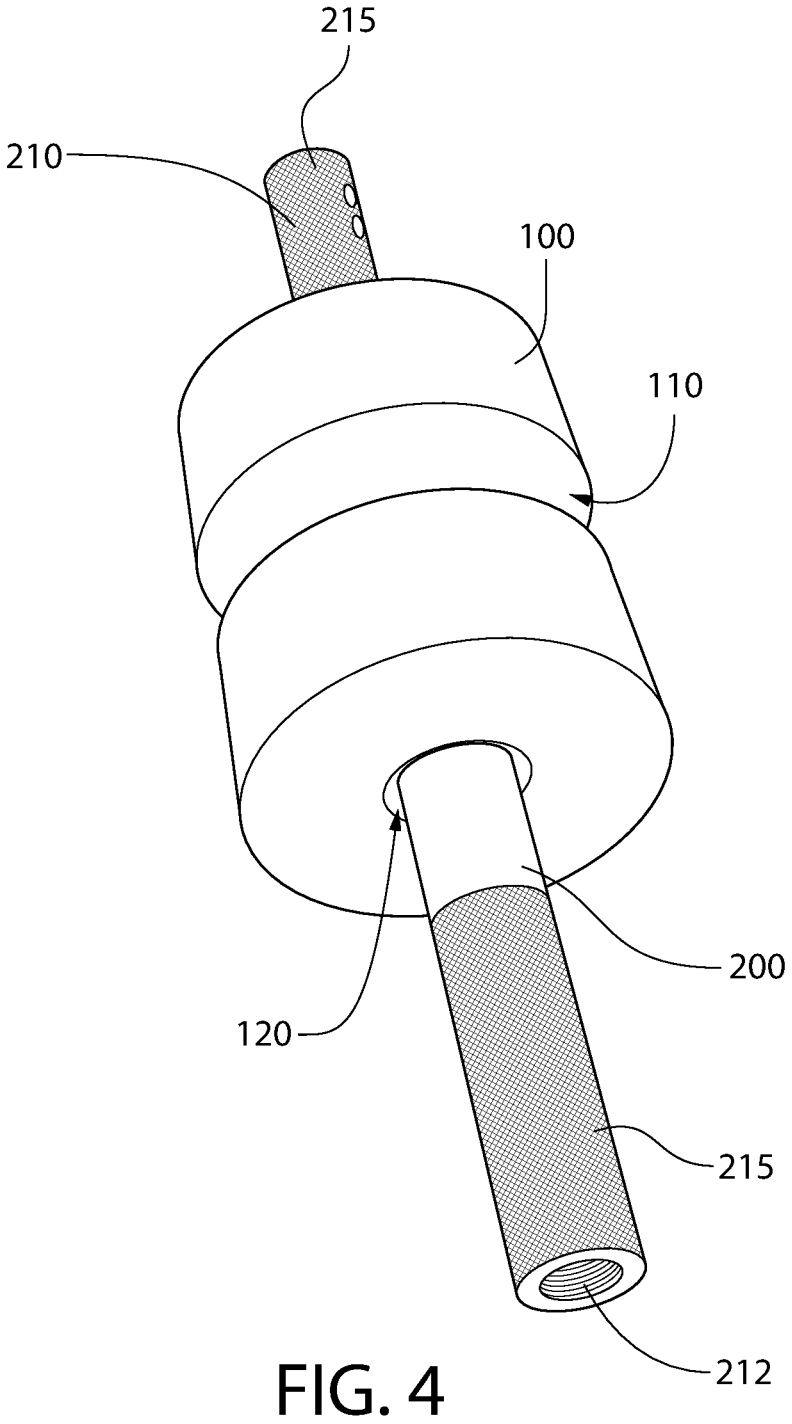
FIG. 4 is a perspective view of the elongated bar positioned within a bore of the cylindrical body.

By having both end regions of the first member 210 formed with a texture, when the first member 210 is used alone for a workout routine without being coupled to the second member 220, a user will still have two textured regions to grip onto (one for each hand). Specifically, as depicted in FIG. 4, in one use only the first member 210 is inserted through the bore 120 of the cylindrical body 100 to reduce the amount of the elongated bar 200 that would otherwise extend from the bore 120. Because the first member 210 has two textured regions 215, one for each hand, a user will be able to achieve an acceptable grip on the first member 210 of the elongated bar 200 during use. Furthermore, because the two textured regions 215 are provided on the first member 210 that has the female connector 212, there are no protrusions or other structural features that will dig into the user's hand or otherwise cause discomfort during use.

Figure 9:
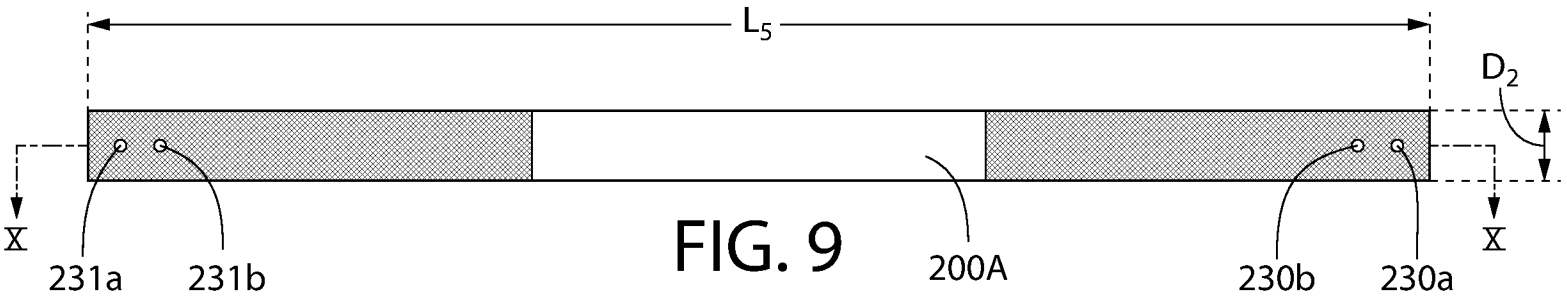
FIG. 9 is a front view of the elongated bar of FIG. 1.
Figure 10:
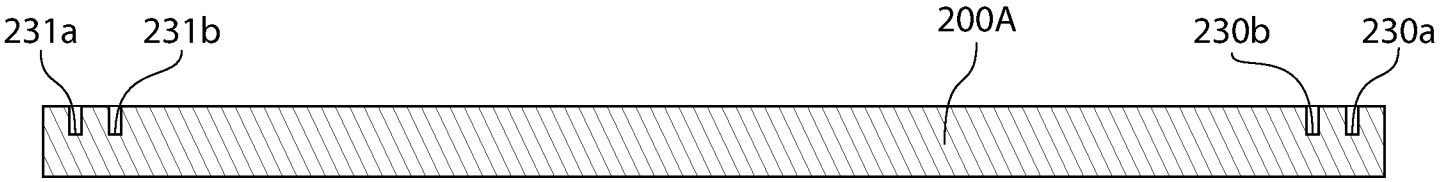
FIG. 10 is a first embodiment of a cross-sectional view taken along line X-X of FIG. 9.

Referring briefly to FIGS. 9 and 10, an alternative embodiment of an elongated bar 200A is illustrated. In this embodiment, the elongated bar 200A is a single-piece structure such that it does not include separate members that are detachably coupled together. All other features of the elongated bar 200A are the same as the features of the elongated bar 200 described with reference to FIGS. 1 and 11 and described below with regard to FIGS. 9-11, except with regard to the location of the textured regions of the bar 200A, as discussed below. In one embodiment, the cylindrical body 100, the two-piece bar 200, the one-piece bar 200A, and one or more of the resistance bands 300 may be sold and/or packaged together as a kit. In one embodiment the kit may include only one of the two-piece bar 200 and the one-piece bar 200A, although in other embodiments both of the two-piece bar 200 and the one-piece bar 200A may be included in the kit. The kit may, in some embodiments, include any of two or more of the components described herein.

Figure 11:
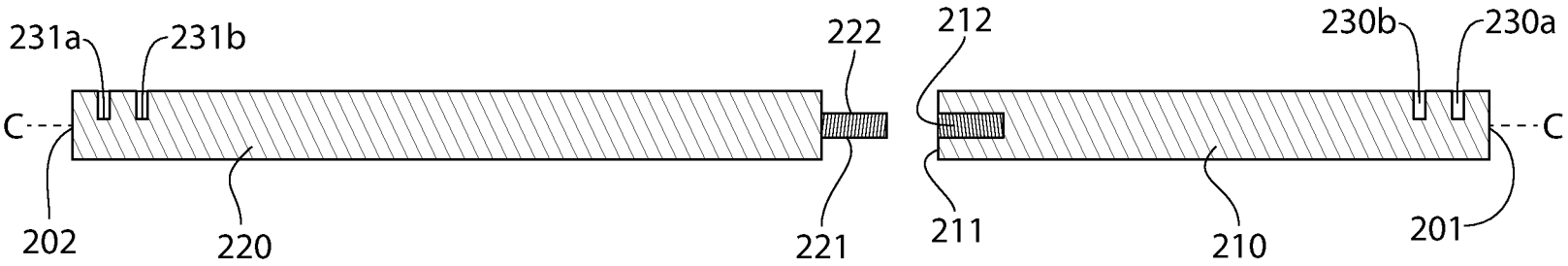
FIG. 11 is a second embodiment of a cross-sectional view taken along line X-X of FIG. 9.

Referring to FIGS. 9-11 concurrently, the elongated bar 200 will be further described. The elongated bar 200 may be formed of a metal material, such as steel, chrome, black oxide, aluminum, or any other metal commonly used in weight training or for exercise purposes. In one particular embodiment, the elongated bar 200 is formed of aluminum with a black anodize finish. Of course, the invention is not to be so limited in all embodiments and in certain other embodiments the elongated bar 200 may be formed of other materials as desired. Specifically, in one embodiment the elongated bar 200 may be formed of a composite material, such as any hard plastic including without limitation acrylonitrile butadiene styrene (ABS). When formed of a hard plastic, the elongated bar 200 can be formed in a mold which simplifies the manufacturing process and may result in a lighter weight product.

Furthermore, the elongated bar 200 may have a weight in a range of 2-6 lbs., and more specifically approximately 4.4 lbs. The elongated bar 200 may have a fifth length $L_5$ that is between 25 and 45 inches, more specifically between 30 and 40 inches, and still more specifically approximately 35 inches or approximately 36 inches. In certain embodiments, the fifth length $L_5$ is greater than the fourth length $L_4$ of the cylindrical body 100. More specifically, in certain embodiments a ratio of the fifth length $L_5$ to the fourth length $L_4$ is between 5.5:1 and 6.5:1, more specifically between 5.8:1 and 6.2:1, and still more specifically approximately 6:1. As a result, a portion of the elongated bar 200 protrudes from both of the first and second ends 101, 102 of the cylindrical body 100 when the elongated bar 200 is positioned within the bore 120 of the cylindrical body 100, as depicted in FIG. 4.

Referring again to the single-piece bar embodiment depicted in FIGS. 9 and 10, in one specific embodiment the bar 200A will have two textured or knurled regions that extend from each of the opposing ends of the bar approximately 14 inches inwardly towards the center of the bar. Because the bar 200A may be 36 inches in one embodiment, such a bar may have approximately 8 inches in the central region of the bar 200A that is smooth and free of texturing or knurling. This central region of the bar 200A may be left smooth so that when the bar 200A is inserted into the bore 120 of the cylindrical body 100, the smooth portion of the bar 200A engages the inner surface 103 of the cylindrical body 100 that defines the bore 120. Of course, the 14 inch and 8 inch dimensions are mere examples, and other lengths of the bar may be knurled/textured and smooth in other embodiments. Specifically, in one embodiment opposite ends of the bar may have anywhere from 5 inches to 15 inches that is textured/knurled, and the center region of the bar may have anywhere from 6 inches to 26 inches that is left smooth and free of texturing/knurling. It is merely important that in one embodiment a central region of the bar 200A that engages the cylindrical body 100 when the bar is inserted into the bore 120 is left smooth and free of texturing/knurling. Preferably, the portion of the central region of the bar 200A that is smooth has a length that is equal to or greater than the length of the cylindrical body 100 (or at least the length of the bore 120 of the cylindrical body 100).

Furthermore, in embodiments that utilize the two-piece bar 200, at least the first member 210 of the two piece bar 200 that has the two textured regions 215 may have a length that is greater than the fourth length $L_4$ of the cylindrical body 100. Thus, when the first member 210 of the elongated bar 200 is used alone for a workout as depicted in FIG. 4, at least a portion of (and possibly the entirety of) the textured regions 215 on each side of the first member 210 will protrude from the cylindrical body 100 for gripping by a user to achieve a desired workout routine while the smooth portion of the first member 210 engages the cylindrical body 100 within the bore 120.

Referring again to FIGS. 9-11, in the exemplified embodiment the elongated bar 200 has a second diameter $D_2$. In certain embodiments the second diameter $D_2$ is between 1.0 and 1.5 inches, more specifically between 1.15 and 1.35 inches, and still more specifically approximately 1.25 inches. Thus, the second diameter $D_2$ of the elongated bar 200 is less than the first diameter $D_1$ of the bore 120, which enables the elongated bar 200 to be inserted into the bore 120 as discussed in more detail below with reference to FIG. 4. Furthermore, the second diameter $D_2$ is less than the third length $L_3$ of the groove portion 106 of the cylindrical body 100, which enables the elongated bar 200 to be positioned within the annular groove 110 when desired. In certain embodiments, the ratio of the third length $L_3$ to the second diameter $D_2$ is between 1.25:1 and 1.5:1, more specifically between 1.3:1 and 1.4:1, and still more specifically approximately 1.36:1.

In the exemplified embodiment, the difference between the third length $L_3$ of the groove portion 106 (which may also be considered the width of the annular groove 110) and the second diameter $D_2$ of the elongated bar 200 is kept to a minimum to ensure that there is minimal "play" or movement between the elongated bar 200 and the cylindrical body 100 in the longitudinal direction of the cylindrical body 100 when the elongated bar 200 is positioned within the annular groove 110. In that regard, in certain embodiments the difference between the third length $L_3$ of the groove portion 106 and the second diameter $D_2$ of the elongated bar 200 is between 0.3 and 0.6 inches, more specifically between 0.4 and 0.5 inches, and still more specifically approximately 0.45 inches. Thus, referring briefly to FIG. 3, when the elongated bar 200 is positioned within the annular groove 110, in certain embodiments there may be a gap $G_1$ of between 0.1 and 0.4 inches, more specifically between 0.2 and 0.3 inches, and still more specifically approximately 0.225 inches between each of the first and second ends 113, 114 of the annular groove 110 and the outer surface of the elongated bar 200.

Thus, in one exemplary embodiment (see FIG. 3), the elongated bar 200 can nest within the annular groove 110 so that the outer surface of the elongated bar 200 is in contact with the floor 111 of the groove 110 and is positioned inwardly of (i.e., spaced apart from/not in contact with) the first and second ends 113, 114 of the annular groove 110. However, in other embodiments the third length $L_3$ of the annular groove 110 may be reduced slightly so that when the elongated bar 200 nests within the annular groove 110, the outer surface of the elongated bar 200 rests atop of the first and second ends 113, 114 of the annular groove 110, and the outer surface of the elongated bar 200 is spaced from the floor 111 of the annular groove 110. In such embodiment, the elongated bar 200 may be in rolling contact with the first and second ends 113, 114 of the annular groove 110 rather than with the floor 111 of the annular groove 110. In other embodiments the elongated bar 200 may be in rolling contact with the first and second ends 113, 114 of the elongated groove 110 and with the floor 111 of the annular groove 110.

Referring back to FIG. 1, the resistance bands 300 will be further described. In the exemplified embodiment there are four resistance bands 300 illustrated that form a part of the system 1000 or kit. However, more or less than four resistance bands 300 can form a part of the system 1000 or kit in other embodiments. The resistance bands 300 can be any type of resistance cords that are commonly used during exercise routines such that the resistance bands 300 stretch when a force is applied to them and retract/bias back to their original size and shape after the force is no longer being applied to them. The resistance bands 300 can be bungee cords or shock cords in certain embodiments that are formed from one or more elastic strands that form a core and are covered in a woven cotton or polypropylene sheath. Alternatively, the resistance bands 300 can be bands formed of an elastic material, like a thick and oversized rubber band. Furthermore, the resistance bands 300 can be any type of latex product that has an inner diameter and an outer diameter, such as a tube-shaped latex product that has a hollow interior extending along its length. Thus, any band or cord that can stretch from its original length when a force is applied thereto while providing resistance and which will bias back to its original length when the force is no longer being applied thereto may be used as the one or more resistance bands 300. The resistance bands 300 can each have different levels of resistance, or they may all have the same resistance as desired. Each of the resistance bands 300 has a hook 301 on both of its opposing ends to facilitate attachment of the resistance bands 300 to the elongated bar 200.

In one embodiment, a central portion of the resistance bands 300 located centrally between the opposing ends of the resistance bands 300 (and centrally between the hooks 301 on the opposing ends of the resistance bands 300) will be marked with a marker 302 that has a color that contrasts with the color of the remainder of the resistance band 300. Thus, if the resistance band 300 is red, the marker 302 can be any color other than red (such as black, white, green, blue, etc.). Although depicted herein as being square in shape, the marker 302 can take on any polygonal shape, or can be in the form of a ring that circumscribes the resistance band 300 at a particular axial location on the resistance band 300. This marker 302 marks the spot where a user can stand on the resistance bands 300 during use to anchor the resistance bands 300 to the floor to achieve a workout while obtaining the most resistance from the resistance band 300. In FIG. 1, the bottom one of the resistance bands 300 has a single marker 302 that is centrally located between the ends of the resistance band 300. A single marker 302 may provide a position that a user should anchor the resistance band 300 with a single foot when such single anchoring is desired for certain exercises. In FIG. 1, the second to the bottom one of the resistance bands 300 has two markers that are equidistantly spaced from the center of the resistance band 300. Two markers 302 may be provided on a single resistance band 300 to provide positions that a user should anchor the resistance band 300 with both feet such dual anchoring is desired for certain exercises.

Figure 12:
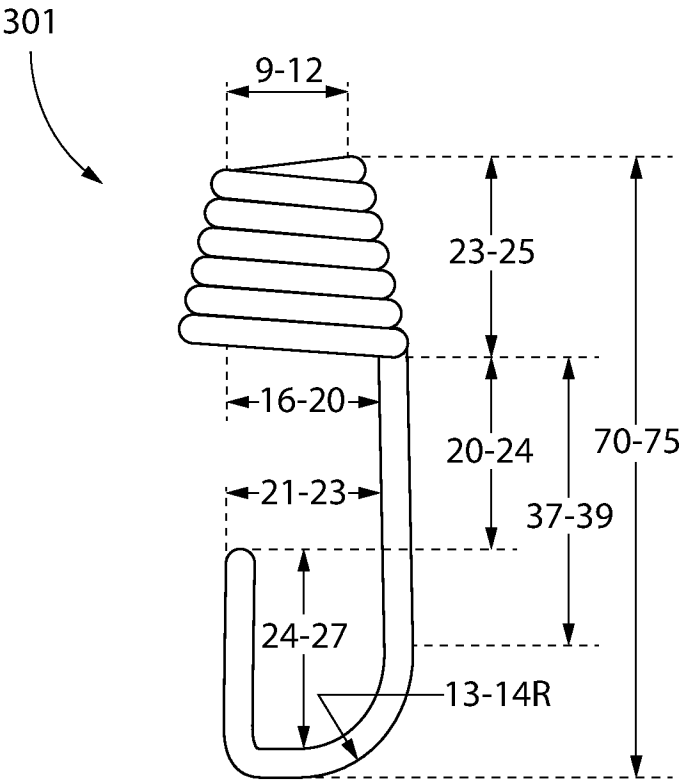
FIG. 12 is a front view of a hook portion of the resistance bands in accordance with an embodiment of the present invention.

One exemplified embodiment of the hook 301 is illustrated in FIG. 12. In FIG. 12, several of the dimensions are provided for the various portions of the hook 301. The dimensions are provided in millimeters. Of course, variations in the size, shape, and various dimensions of the hook 301 are possible in certain embodiments. It is merely desired that the hook 301 be capable of being inserted into the holes 230*a*, 230*b*, 231*a*, 231*b* of the elongated bar 200 to removably couple the resistance bands 300 to the elongated bar 200, as discussed below with reference to FIG. 5.

Figure 3:
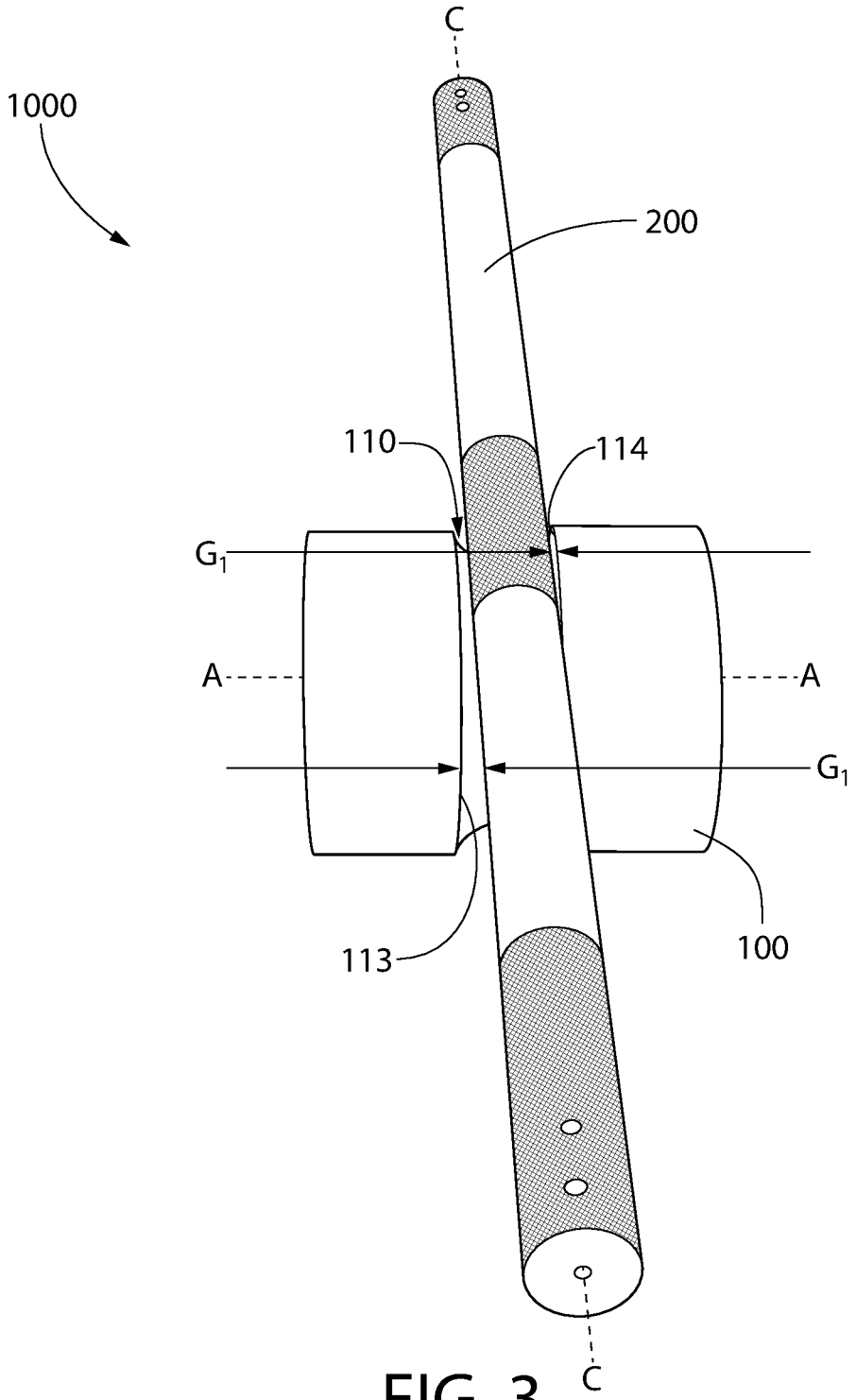
FIG. 3 is a perspective view of the elongated bar positioned within an annular groove of the cylindrical body.

Referring to FIG. 3, the system 1000 is illustrated with the elongated bar 200 positioned within the annular groove 110 of the cylindrical body 100. In this embodiment, the elongated bar 200 fits within the annular groove 110 because the length $L_3$ of the groove portion 106 of the cylindrical body 106 measured between the first end 113 of the annular groove 110 and the second end 114 of the annular groove 110 is greater than the second diameter $D_2$ of the elongated bar 200. Furthermore, the ratio of the third length $L_3$ of the groove portion 106 to the second diameter D2 of the elongated bar 200 is, as discussed above, between 1.25:1 and 1.5:1, more specifically between 1.3:1 and 1.4:1, and still more specifically approximately 1.36:1, which provides a limited amount of "play" between the outer surface of the elongated bar 200 and the first and second ends 113 of the annular groove 110. Thus, when the elongated bar 200 is positioned within the annular groove 110, minimal (if any) movement of the elongated bar 200 in the direction of the longitudinal axis A-A of the cylindrical body 100 is permitted. Rather, the elongated bar 200 nests within the annular groove 110 and remains so positioned due to the combination of the depth $d_1$ of the annular groove 110, the diameter $D_2$ of the elongated bar 200, and the length $L_3$ of the annular groove 110.

When the elongated bar 200 is nested within the annular groove 110, the annular bar 200 is able to readily slide or roll within the annular groove 110 (or relative to the annular groove 110) in a direction transverse to the longitudinal axis A-A of the cylindrical body 100 and along the direction of the longitudinal axis C-C of the elongated bar 200. Specifically, with the elongated bar 200 in the annular groove 110, a user will grip opposite ends of the elongated bar 200 while the user is in a push-up (or modified push-up) position, putting all (or some) of his or her weight on the elongated bar 200. The user will be able to move the elongated bar 200 from left to right and from right to left (in both opposing directions of the longitudinal axis of the elongated bar 200), which will cause the cylindrical body 100 to roll along the floor or other horizontal surface upon which it is resting in the same direction of movement of the elongated bar 200. Specifically, the cylindrical body 100 will roll along the floor and the elongated bar 200 will remain nested within the annular groove 110 during this exercise routine. Thus, as the cylindrical body 100 rolls along the floor, the portion of the elongated bar 200 (the longitudinal location of the elongated bar 200) that is positioned within the annular groove 110 will change.

Furthermore, while the elongated bar 200 is positioned within the annular groove 110, the elongated bar 200 is also able to pivot about an axis that is perpendicular to the longitudinal axis C-C and that intersects the portion of the elongated bar 200 that is in surface contact with the floor 111 of the annular groove 110 to work different muscles of the user's body. Thus, the elongated bar 200 can be pivoted so that one end of the elongated bar 200 is tilted upwards while the other end of the elongated bar is tilted downwards. This can enable the user to strengthen or exercise different parts of a muscle depending on the tilt angle of the elongated bar 200 (for example, different parts of the pectoralis muscle can be exercised depending on the tilt angle/degree/direction of the elongated bar 200).

Figure 5:
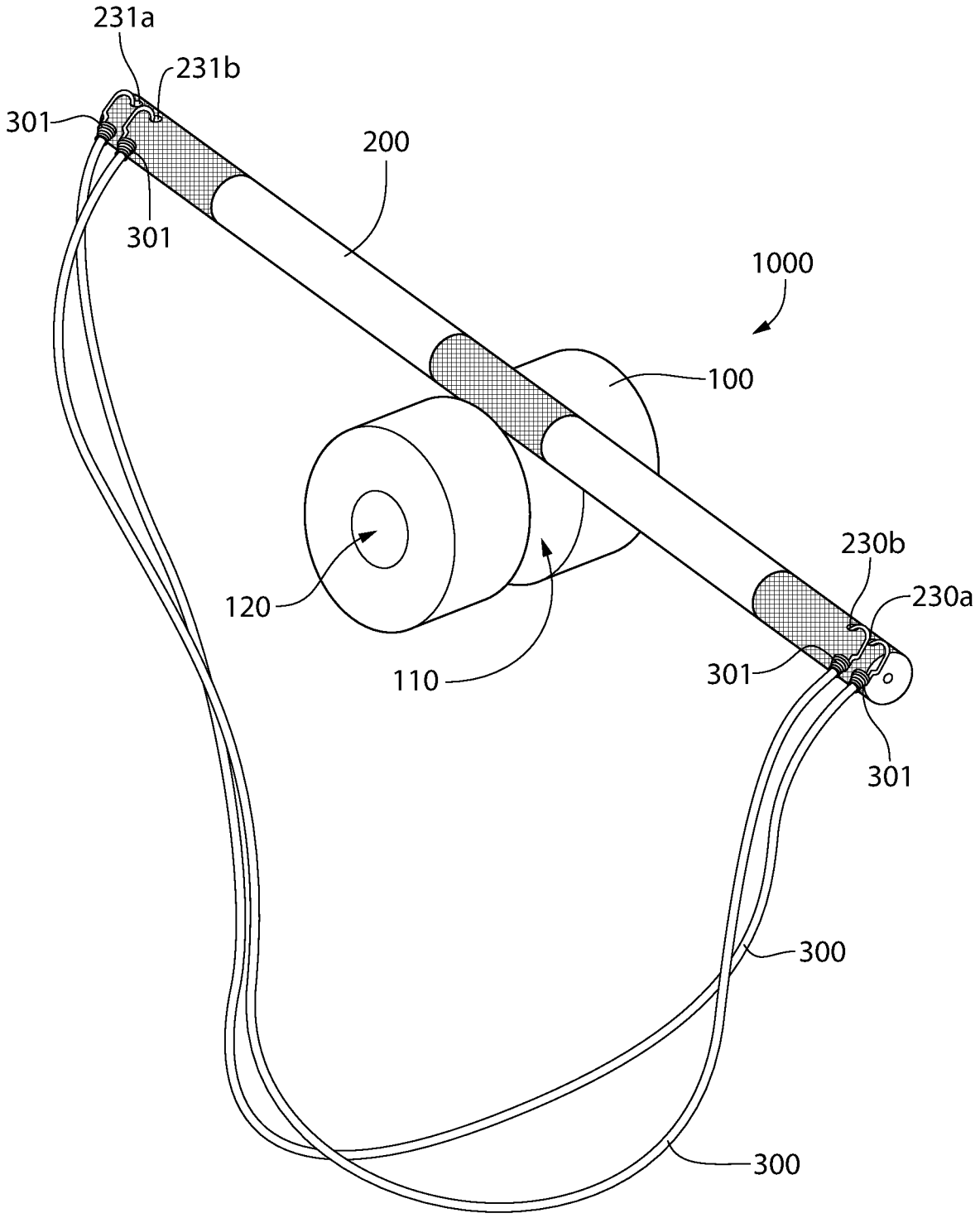
FIG. 5 is a perspective view of the elongated bar positioned within an annular groove of the cylindrical body and two of the resistance bands coupled to the elongated bar.

Referring briefly to FIG. 5, the system is illustrated with the elongated bar 200 positioned within the annular groove 110 of the cylindrical body 100 and with two of the resistance bands 300 detachably coupled to the elongated bar 200. Specifically, to attach the resistance bands 300 to the elongated bar 200, the hooks 301 of the resistance bands 300 are slid into the openings 230*a*, 230*b*, 231*a*, 231*b* of the elongated bar 200. Specifically, the hooks 301 of a first one of the resistance bands 300 are inserted into one of the holes 230*a*, 230*b* and one of the holes 231*a*, 231*b* and the hooks 301 of a second one of the resistance bands 300 are inserted into the other one of the holes 230*a*, 230*b* and the other one of the holes 231*a*, 231*b*. In certain embodiments, only one of the resistance bands 300 may be coupled to the elongated bar 200, and in other embodiments more than two resistance bands may be coupled to the elongated bar 200 when additional holes are provided.

When the resistance bands 300 are coupled to the elongated bar 200, a central portion of the resistance bands 300 that is located in between the two ends with the hooks 301 may be positioned within the annular groove 110 so as to be trapped between the cylindrical body 100 and the floor. In this position, the user can work out his or her biceps by curling the elongated bar, triceps by doing overhead extensions, deltoids by doing shoulder presses, trapezius by doing shrugs, quadriceps by doing squats, or the like. The user may rest one of his or her feet on the cylindrical body 100 when doing these exercises to ensure that the cylindrical body 100 remains in surface contact with the floor with the resistance bands 300 trapped between the cylindrical body 100 and the floor. This will ensure that the resistance bands 300 stretch during these exercises rather than lifting the cylindrical body 100 off of the floor. Alternatively, the user may use the resistance bands and the elongated bar 200 separate from the cylindrical body 100 by the user standing on the central portion of the resistance bands 300 and doing the above-noted exercises.

Referring to FIG. 4, the system is illustrated with the elongated bar 200 positioned within and through the bore 120 of the cylindrical body 100. Because the first diameter $D_1$ of the bore 120 is larger than the second diameter $D_2$ of the elongated bar 200, the elongated bar 200 is able to be inserted into and through the bore 120. In this figure, only one of the members of the two-piece bar is illustrated positioned within the bore 120. However, the members can be coupled together and then inserted into the bore 120, or a single-piece elongated bar can be used. When the elongated bar 200 is positioned within the bore 120, a user can exercise by getting on his or her knees and grabbing hold of the opposite ends of the elongated bar 200. The user can then slide/roll the elongated bar 200 and the cylindrical body 100 in a direction away from and towards the user to achieve an abdominal/core/full body workout. Variations of this particular workout can be achieved as would be understood by persons of skill in the art, such as by the user being positioned on his or her toes and then sliding/rolling the elongated bar 200 and the cylindrical body 100 in a direction away from and towards the user. Furthermore, in some embodiments the resistance bands 300 can be coupled to the elongated bar 200 when the elongated bar 200 is positioned within the bore 120 of the cylindrical body 100 and exercise routines can be conducted with the system 1000 in that position.

As can be seen in FIG. 4 and as discussed above, in one embodiment it may be desirable to use the first member 210 of the two-piece elongated bar 200 for this exercise because the first member 210 has the two textured regions 215, is longer than the bore 120, and is not as long as the elongated bar 200 in its entirety so it takes up less space during a workout routine. Furthermore, the first member 210 has the female threaded connector 212, so there are no protruding structures that can damage the user's hand or cause discomfort during use.

Figure 13:
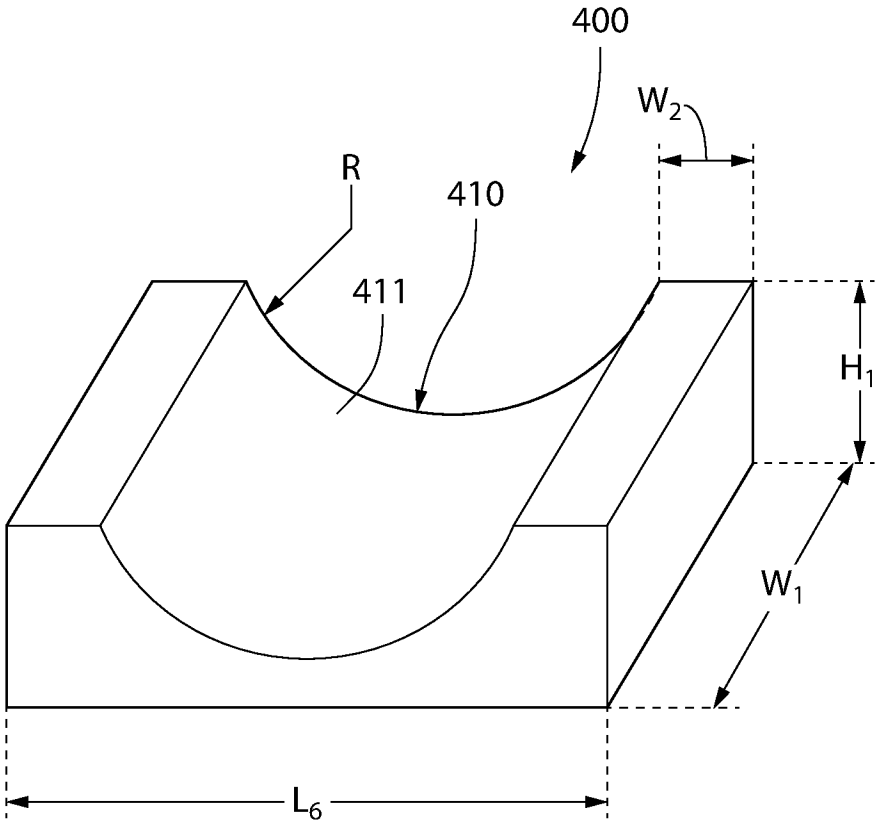
FIG. 13 is a perspective view of a cradle in accordance with an embodiment of the present invention.

Finally, referring to FIG. 13, a cradle 400 is illustrated. The cradle 400 may be used for storage of the cylindrical body 100, or it may be used as a sort of training wheels that prevents the cylindrical body 100 from rotating along the floor during use. Thus, the above exercises can be conducted while the cylindrical body 100 is nested in the cradle 400 to prevent rolling movement of the cylindrical body 100 during the workout routine. In certain embodiments the cradle 400 may be sold together with the cylindrical base 100, the elongated bar 200, and the one or more resistance bands 300 in the kit. In other embodiments, the cradle 400 may be sold separately from the other components on an as-needed basis. The cradle 400 may be formed of any desired material, including metals, metal alloys, plastics, rubbers, or the like.

Various dimensions of the cradle 400 will be described below. However, it should be appreciated that the dimensions of the cradle 400 can be modified depending on the dimensions of the cylindrical body 100 which is used with the cradle 400. The cradle 400 has a sixth length $L_6$ that is between 6.6 and 7.0 inches, and more specifically approximately 6.8 inches. The cradle 400 has a first width $W_1$ that is between 5.6 and 6.4 inches, and more specifically approximately 6.0 inches. The cradle 400 has a height $H_1$ that is between 2.0 and 2.6 inches, and more specifically 2.3 inches. The cradle 400 has a second width $W_2$ which is between 0.8 and 1.2 inches, and more specifically approximately 1.0 inches. Furthermore, the shape of the cradle 400 defines a cavity 410 within which the cylindrical body 100 may be positioned as desired. The cavity 411 has a floor with a radius of curvature R. The radius of curvature R may be between 2.5 and 2.8 inches, more specifically between 2.6 and 2.7 inches, and still more specifically approximately 2.62 inches.

Referring to FIGS. 14-27B, an exercise system or kit 2000 will be described in accordance with another embodiment of the present invention. The term exercise kit 2000 will be used herein to describe FIGS. 14-27B, but the term exercise system is equally applicable. The exercise kit 2000 comprises a set of articles or equipment that can be used together to enable a user to perform multiple different exercises. The exercise kit 2000 is similar to the exercise system 1000 described above and thus certain features of the exercise kit 2000 may not be described in detail herein below. For those features, the description of the exercise system 1000 provided above may be applicable.

Figure 14:
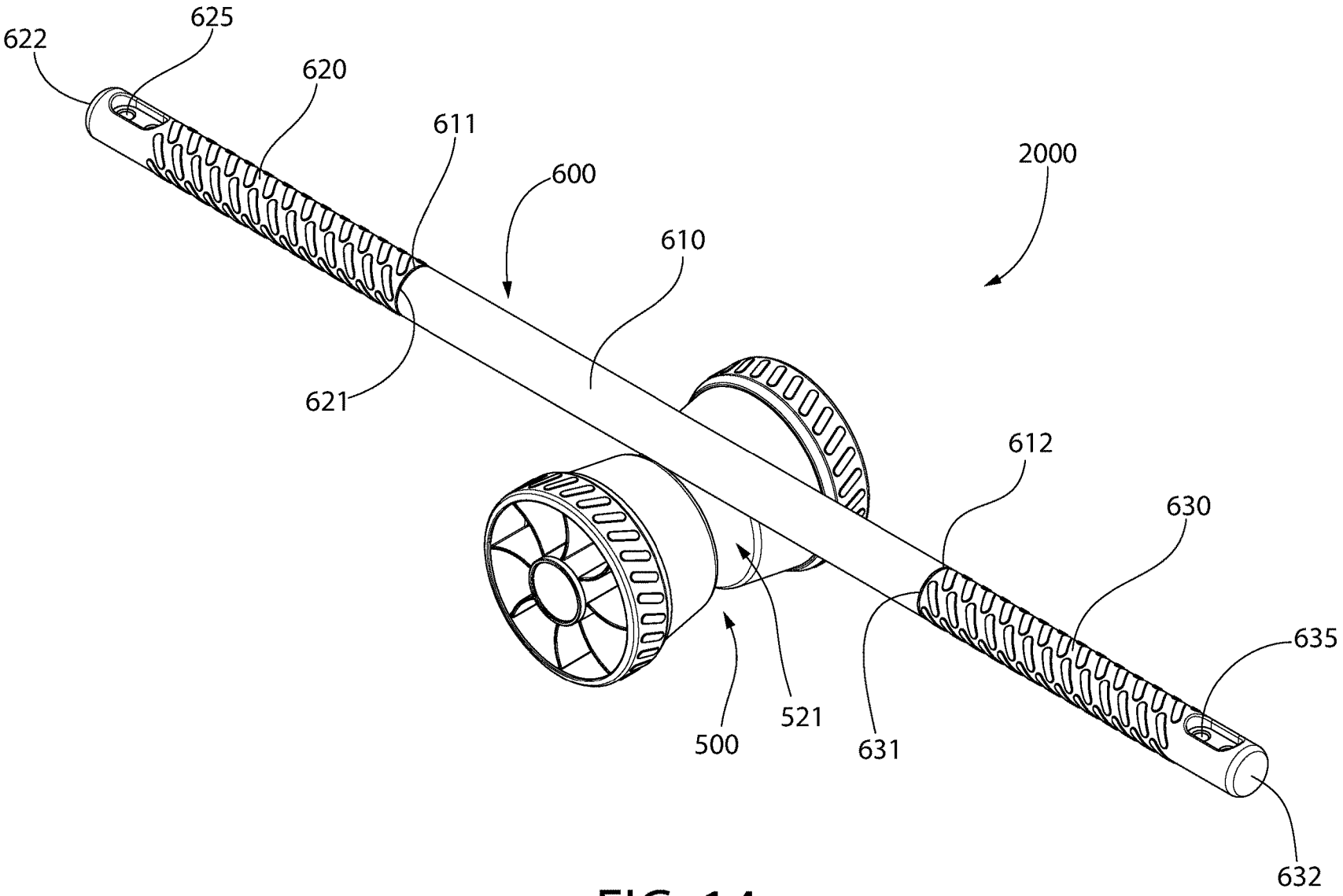
FIG. 14 is a perspective view of an exercise kit in accordance with another embodiment of the present invention, the exercise kit including a hub and an elongated bar illustrated in one of several possible exercise positions.
Figure 23:
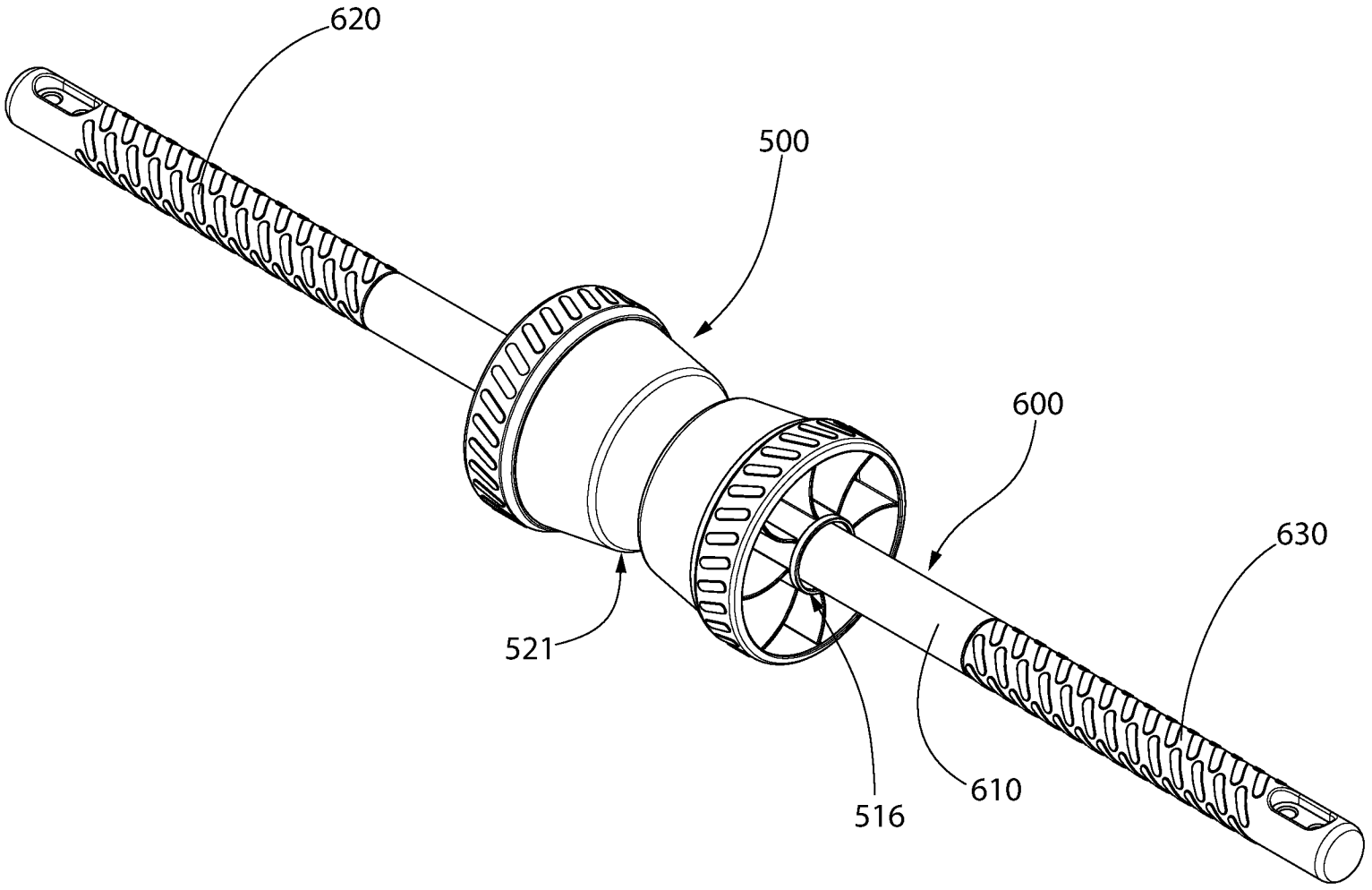
FIG. 23 is a perspective view illustrating the elongated bar interacting with the hub in another of several possible exercise positions.
Figure 24:
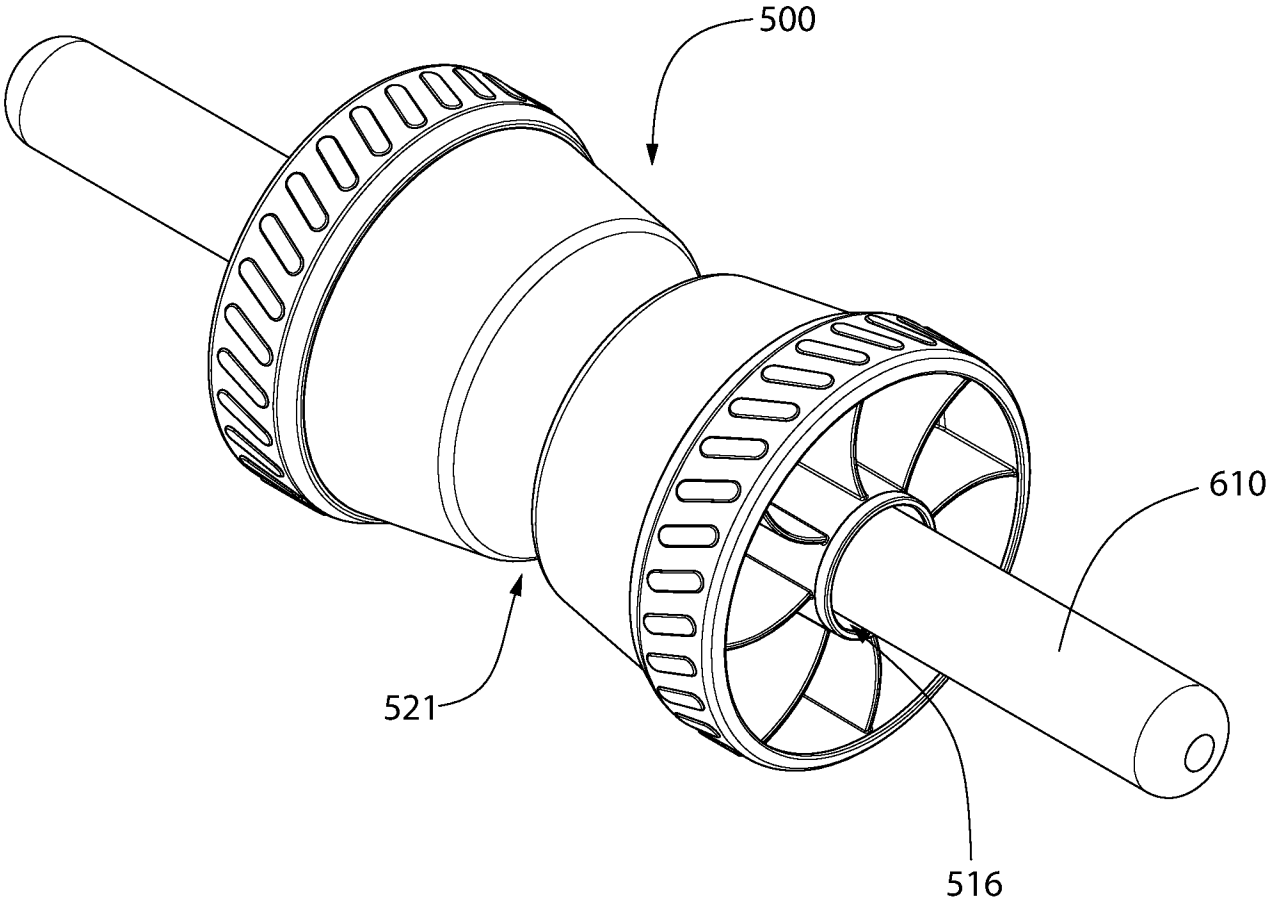
FIG. 24 is a perspective view illustrating the center component of the elongated bar interacting with the hub in still another of several possible exercise positions.

Referring first to FIG. 14, the exercise kit 2000 generally comprises a hub 500 and an elongated bar 600. The exercise kit 2000 may also include resistance bands as described above with regard to the exercise system 1000 and as shown in FIG. 27B. However, in some embodiments the resistance bands may not form a part of the exercise kit 2000. The elongated bar 600 is configured to interact with the hub 500 in multiple different positions to enable a user to perform different exercises. FIG. 14 illustrates the elongated bar 600 interacting with the hub 500 in one such exercise position. FIGS. 23 and 24 illustrate the elongated bar 600 interacting with the hub 500 in other such exercise positions. The specifics of these exercise positions will be described in more detail below. However, a description of the elongated bar 600 and the hub 500 will be provided first.

Figure 15A:
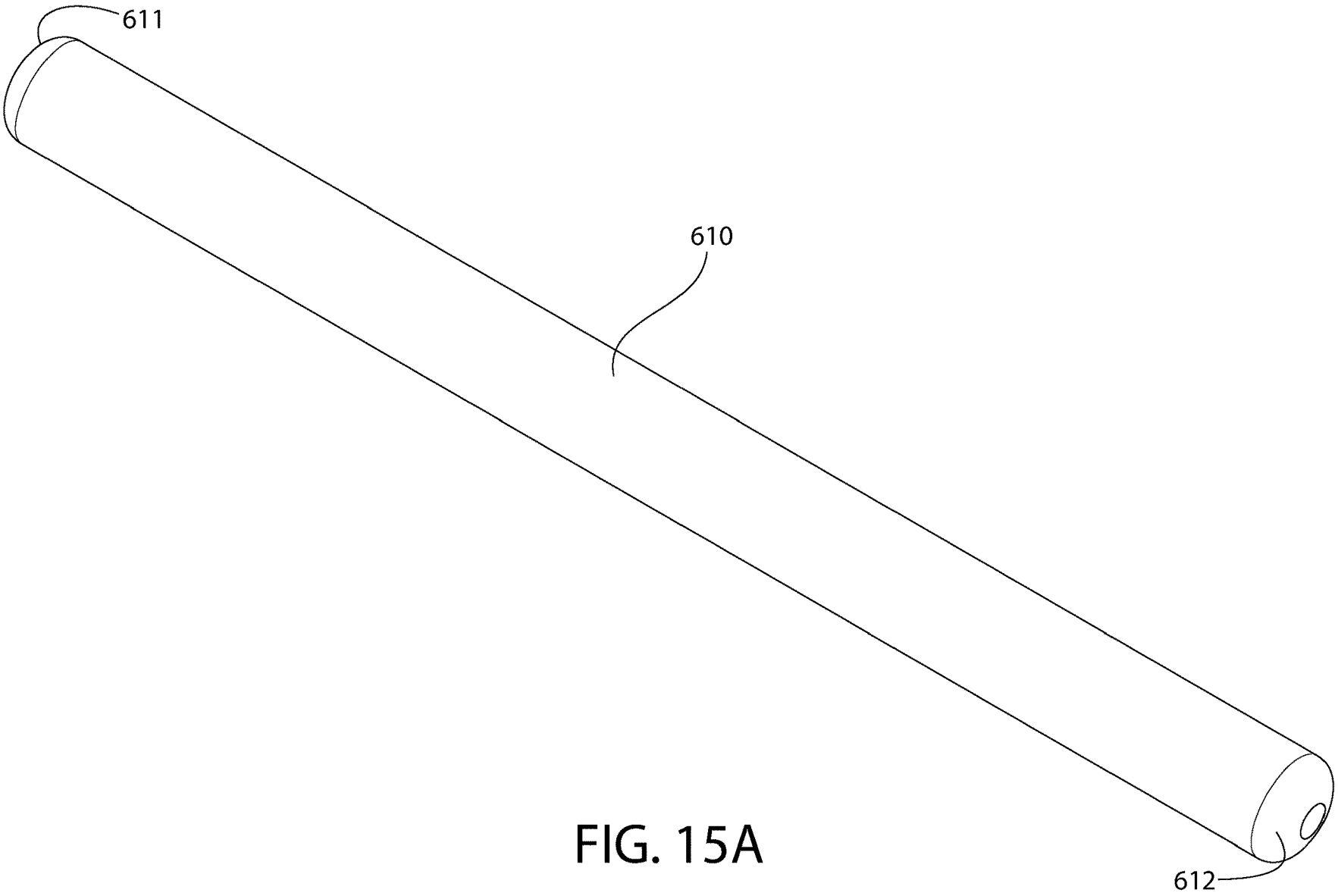
FIG. 15A is a perspective view of a center component of the elongated bar of FIG. 14 in accordance with an embodiment of the present invention.
Figure 15B:
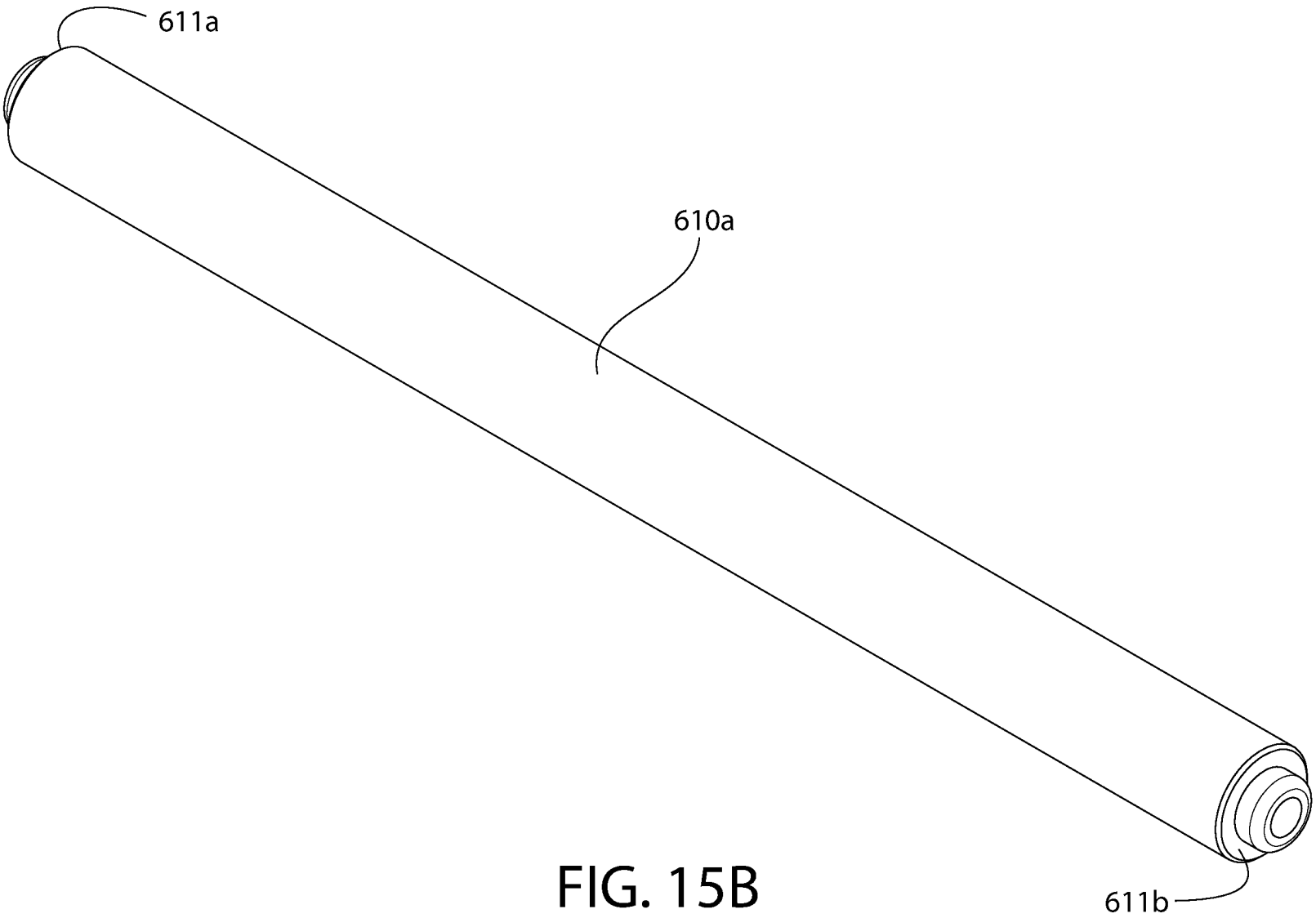
FIG. 15B is a perspective view of a center component of the elongated bar of FIG. 14 in accordance with another embodiment of the present invention.
Figure 16:
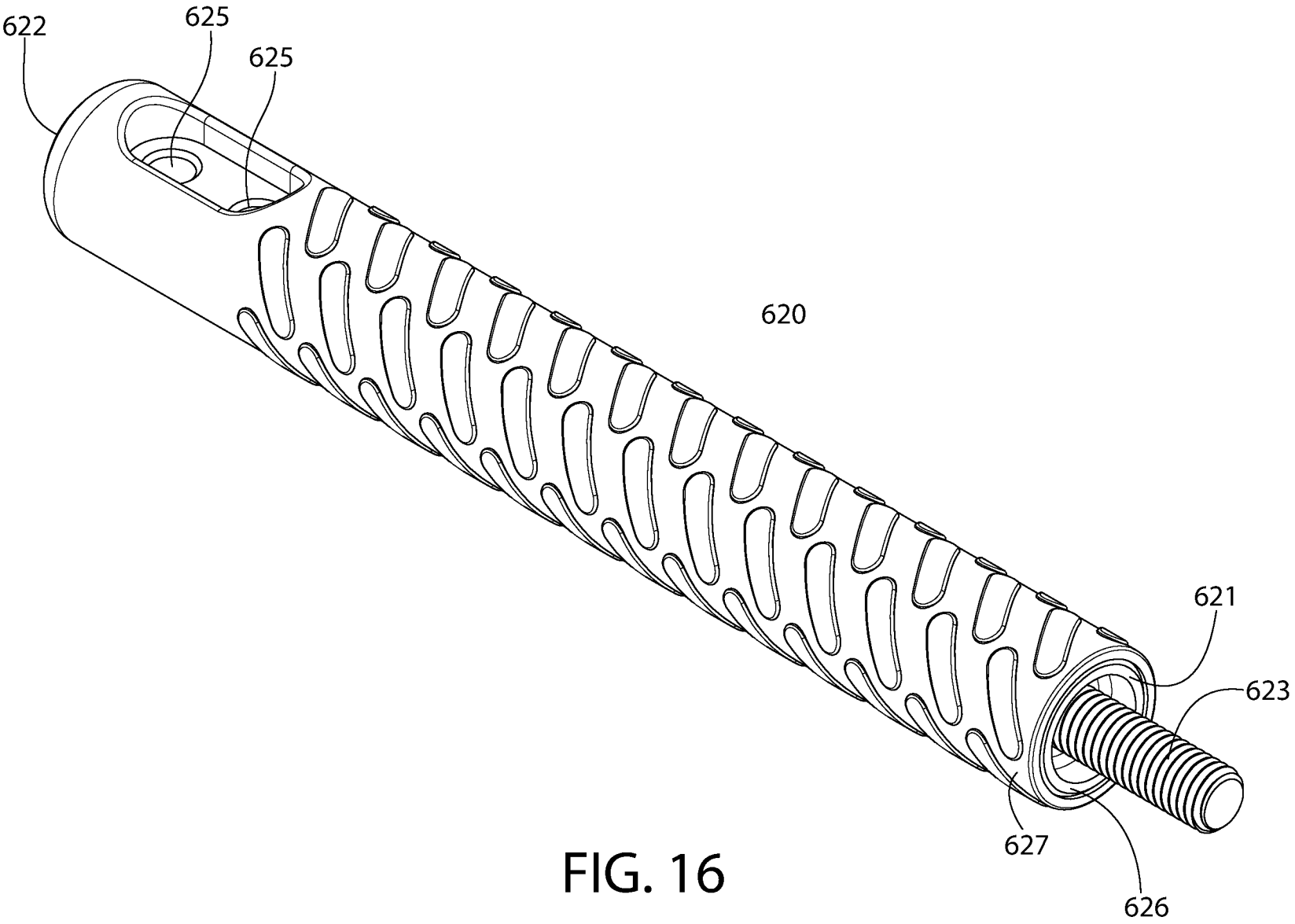
FIG. 16 is a perspective view of a first or second end component of the elongated bar of FIG. 14.
Figure 17A:
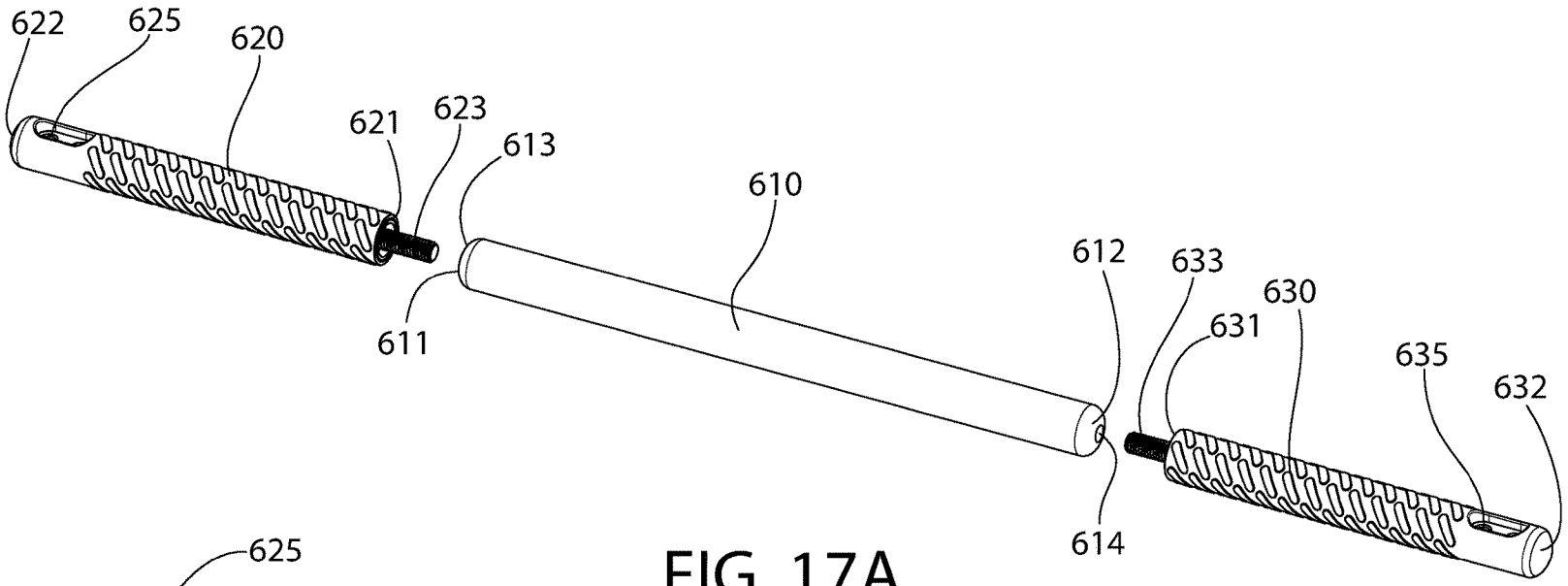
FIGS. 17A and 17B illustrate the manner in which the center component and the first and second end components are detachably coupled together to form the elongated bar of FIG. 14.
Figure 17B:
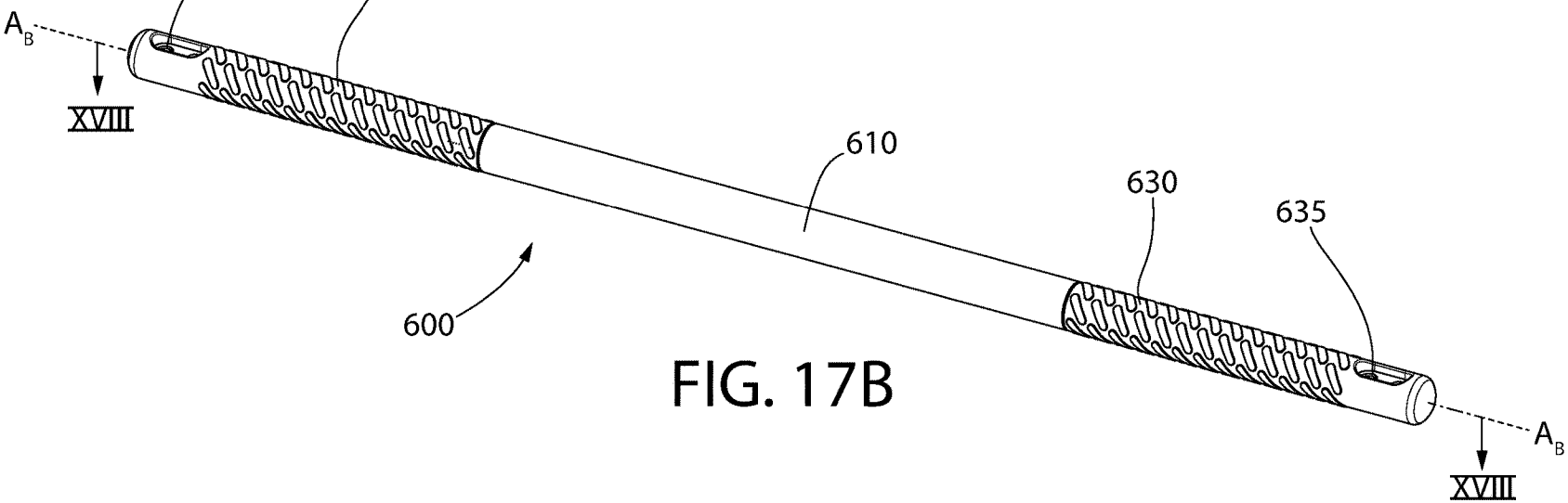
Figure 18:
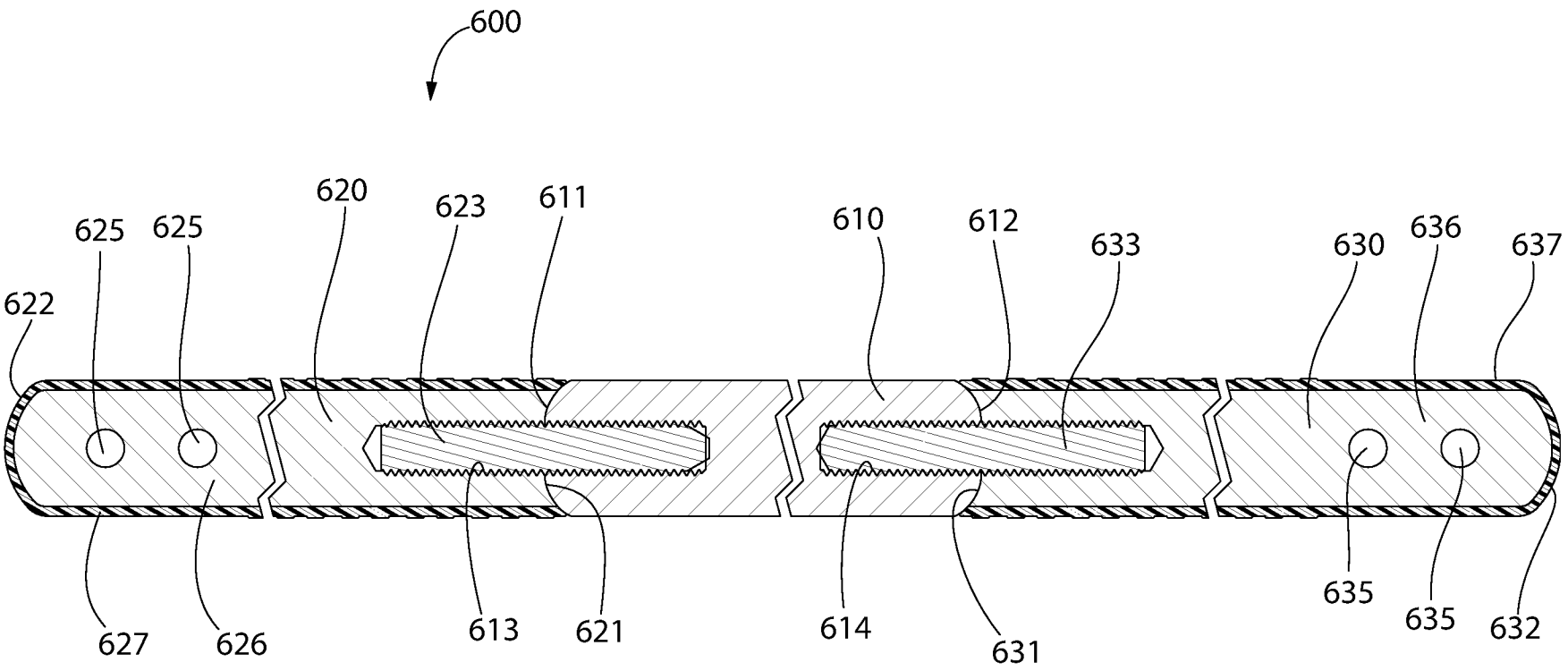
FIG. 18 is a cross-sectional view taken along line XVIII-XVIII of FIG. 17B.
Figure 19:
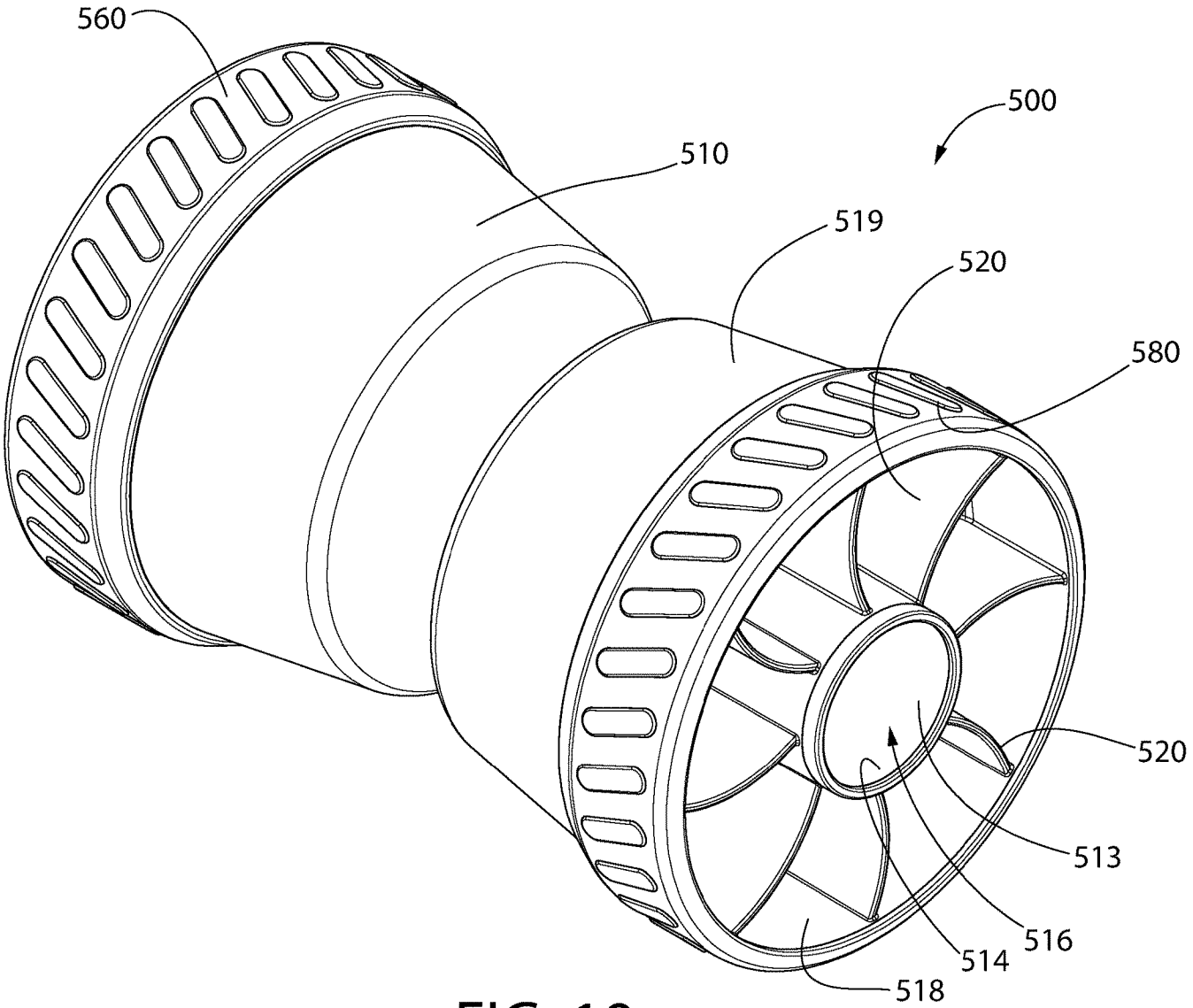
FIG. 19 is a perspective view of the hub of FIG. 14.
Figure 21:
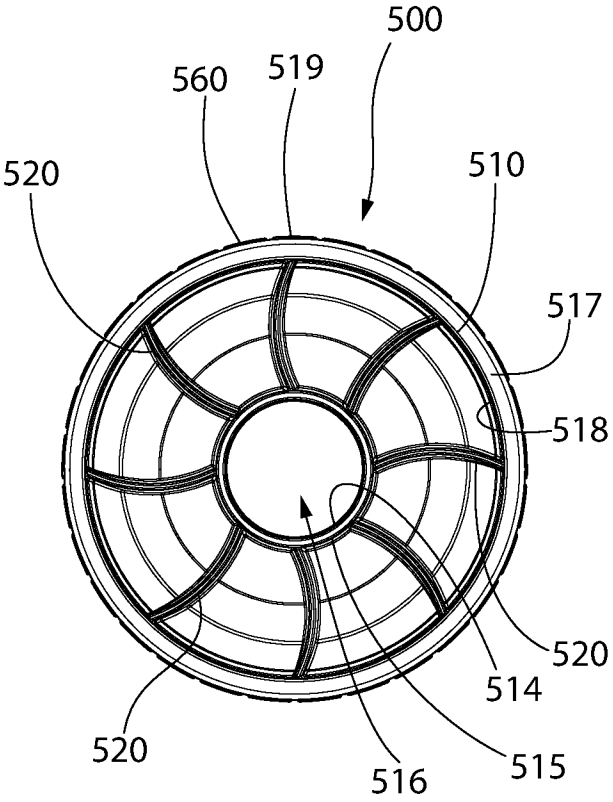
FIG. 21 is a side view of the hub of FIG. 19.
Figure 20:
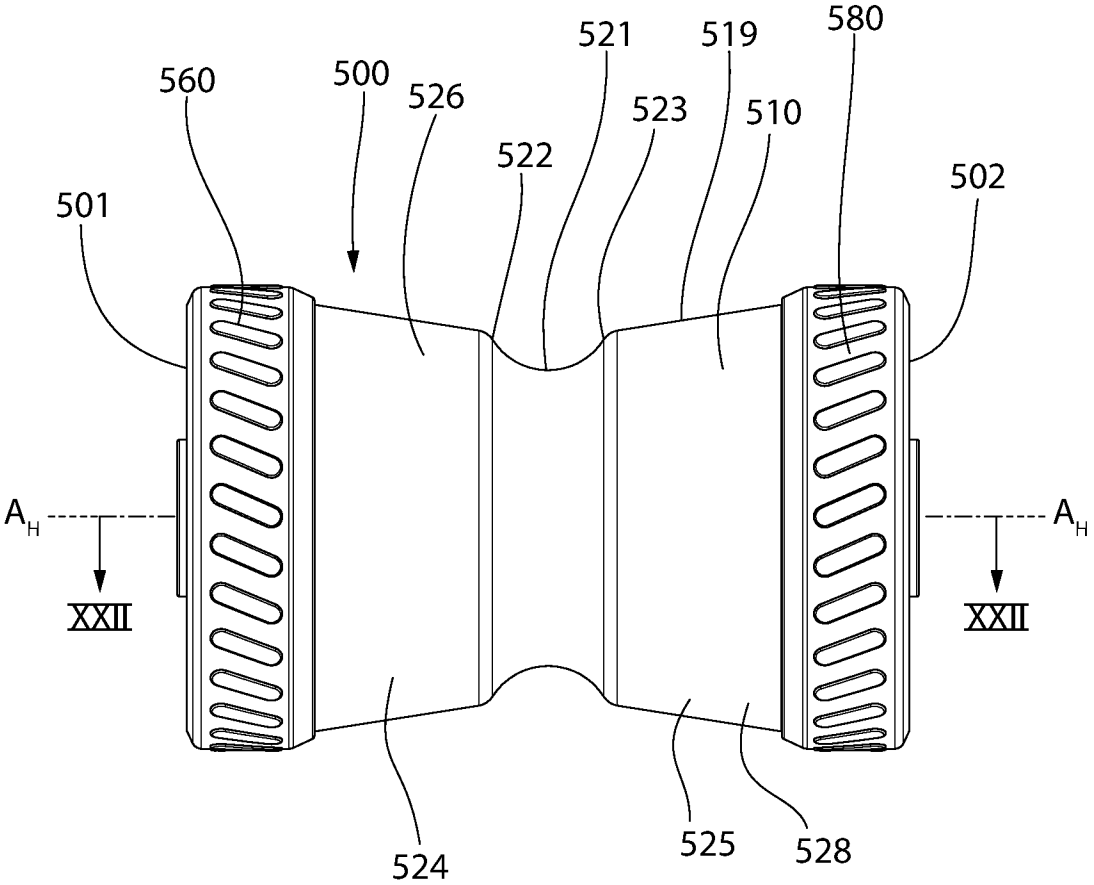
FIG. 20 is a front view of the hub of FIG. 19.

Referring to FIGS. 14-18, the elongated bar 600 comprises multiple parts or components that are coupled together to form the elongated bar 600. Specifically, the elongated bar 600 comprises a center component 610 extending from a first end 611 to a second end 612, a first end component 620 extending from a first end 621 to a second end 622, and a second end component 630 extending from a first end 631 to a second end 632. FIG. 16 illustrates the first end component 620, but the second end component 630 is identical thereto. The first and second end components 620, 630 are both detachably coupled to the center component 610 to form the elongated bar 600.

In that regard, the center component 610 comprises a first connection element 613 at the first end 611 and a second connection element 614 at the second end 612. The first end component 620 comprises a connection element 623 at the first end 621 and the second end component 630 comprises a connection element 633 at the first end 631. In the exemplified embodiment, each of the connection elements 613, 614, 623, 633 comprises screw threads. Specifically, the first and second connection elements 613, 614 of the center component 610 comprise screw threads that are formed into a hole in the first and second ends 611, 612 of the center component. Furthermore, the connection elements 623, 633 of the first and second end components 620, 630 comprise screw threads that are formed on a post or rod that protrudes from the first ends 621, 631 of the first and second end components 620, 630. The first and second end components 620, 630 are therefore coupled to the center component 610 by engaging the screw threads in a conventional manner.

Of course, the invention is not to be so limited and the connection elements 613, 614, 623, 633 can take on other forms. For example, the connection elements 613, 614, 623, 634 could be features that mate with an interference or friction fit, locking tabs, notches, protrusions, screws, bolts, fasteners, clamps, latches, or the like. Regardless of the specific structure of the connection elements 613, 614, 623, 634, they are configured to permit the first and second end components 620, 630 to be detachably coupled to the center component 610 to form the assembled elongated bar 600.

In the embodiment illustrated in FIG. 15A, the center component 610 is rounded at its first and second ends 611, 612. This may be desirable because in some embodiments the center component 610 may interact with the hub 500 to perform exercises without the first and second end components 620, 630 coupled to the center component 610. By rounding the first and second ends 611, 612, the center component 610 will not have any protrusions or the like that could be uncomfortable for a user if the user were to grip the first and second ends 611, 612. FIG. 15B illustrates another embodiment of the center component 610*a* having first and second ends 611*a*, 612*a*. In this embodiment, the first and second ends 611*a*, 612*b* are not rounded but instead have small protrusions that define the holes where the screw threads are formed. This embodiment may be desirable to achieve a more secure coupling between the first and second end components 620, 630 and the center component 610.

In the exemplified embodiment, the first end component 620 comprises one or more holes 625 near the second end 622 thereof and the second end component 630 comprises one or more holes 635 near the second end 632 thereof. More specifically, in the exemplified embodiment the first end component 620 comprises two of the holes 625 and the second end component 630 comprises two of the holes 635. Of course, a single hole or more than two holes could be used in alternative embodiments. The holes 625, 635 provide a location at which a resistance band may be coupled to the elongated bar 600 as has been described above with reference to FIGS. 5 and 12. The coupling of resistance bands to the elongated bar 600 will not be described here in detail in the interest of brevity, it being understood that the description provided above with regard to the exercise system 1000 is applicable to the exercise kit 2000.

The center component 610 may be formed from a machined aluminum having an anodized finish. Of course, alternatives to this are possible so long as the center component 610 has the required strength to operate and function as described herein. The first end component 620 may comprise a core component 626 and a grip component 627. Similarly, the second end component 630 may comprise a core component 636 and a grip component 637. The core components 626, 636 may be formed from aluminum, although other materials are also possible including other metals, injection molded nylon, or the like. The core component 636 may be an aluminum having an anodized finish. The grip components 627, 637 may be formed from a resilient material such as thermoplastic elastomer. The grip components 627, 637 may be injection molded onto the core components 626, 636 or the grip components 627, 637 may be formed separately from the core components 626, 636 and slid onto the core components 626, 636. In such embodiments, the grip components 627, 637 may be secured to the core components 626, 636 using an adhesive, fasteners, or the like. The grip components 627, 637 may include a base and a plurality of textured protrusions to enhance a user's grip thereon.

The elongated bar 600, when assembled, may have a length, measured between the second end 622 of the first end component 620 and the second end 632 of the second end component 630, of between 30 inches and 40 inches. The elongated bar 600 extends from the second end 622 of the first end component 620 to the second end 632 of the second end component 630 along a longitudinal axis $A_B$-$A_B$. The length of each of the first and second end components 620, 630 may be approximately 10 inches and the length of the center component 610 may be approximately 14-18 inches. The elongated bar 600 may also have a diameter of between 1.0 inch and 1.5 inches, and more specifically approximately 1.25 inches. Of course, lengths, diameters, and the like outside of the noted ranges are also possible in other embodiments. In the exemplified embodiment, the diameter of the core components 626, 636 of the first and second end components 620, 630 is less than the diameter of the center component 610. However, the diameter of the first and second end components 620, 630 with the grip components 627, 637 included is the same as the diameter of the center component 610, thereby giving the elongated bar 610 a seamless and flush appearance despite the fact that it is formed from three separate parts. Forming the elongated bar 600 from three separate parts may be desirable in some embodiments to increase the portability of the exercise kit 2000 by enabling it to be placed within a case and carried.

Referring to FIGS. 19-22, the hub 500 will be described. The hub 500 extends from a first end 501 to a second end 502 along a longitudinal axis $A_H$-$A_H$. The hub 500 generally comprises a monolithic body portion 510, a first sleeve portion 560, and a second sleeve portion 580. In the exemplified embodiment, the monolithic body portion 510 is formed as a single, unitary structure. More specifically, in the exemplified embodiment the monolithic body portion 510 is formed via an injection molding process out of a rigid material. In some embodiments, the rigid material may be a hard plastic such as nylon. However, nylon is merely one example and other hard plastics may be used. Alternatively, the monolithic body portion 510 may be formed from metal, wood, or other rigid materials. Furthermore, although illustrated and described herein as being monolithic, in other embodiments the hub 500 may include a non-monolithic body portion such that the body portion is formed from multiple structures or components that are coupled together to form the body portion.

The first and second sleeve portions 560, 580 are formed of a soft, resilient material, such as without limitation thermoplastic elastomer, rubber, silicone, or the like. The first and second sleeve portions 560, 580 may be formed separately from the monolithic body portion 510 and slid onto the monolithic body portion 510. In such an embodiment, the first and second sleeve portions 560, 580 may be affixed or otherwise secured to the monolithic body portion 510 using an adhesive, fasteners, screws, bolts, nails, mechanical interference, tight fit, or the like. Alternatively, the first and second sleeve portions 560, 580 may be injection molded directly onto the monolithic body portion 510. Depending on the material selection, the first and second sleeve portions 560, 580 may bond directly to the material of the monolithic body portion 510.

The monolithic body portion 510 extends from a first end 511 to a second end 512 along the longitudinal axis $A_H$-$A_H$. The monolithic body portion 510 comprises an inner tube 513 having an inner surface 514 and an outer surface 515. The inner surface 514 of the inner tube 513 defines a bore 516 that extends through the entire length of the monolithic body portion 510 from the first end 511 to the second end 512. Thus, the bore 516 is open at both of the first and second ends 511, 512 of the monolithic body portion 510 and thereby forms a passageway through the monolithic body portion 510. The monolithic body portion 510 also comprises an outer body 517 having an inner surface 518 and an outer surface 519. The inner surface 518 of the monolithic body portion 510 is annularly spaced apart from the outer surface 515 of the inner tube 513. Thus, in some embodiments the outer body 517 forms an outer tube that concentrically surrounds the inner tube 513 in a spaced apart manner. The outer surface 519 of the outer body 517 forms an outer surface of the monolithic body portion 510. Furthermore, portions of the outer surface 519 of the outer body 517 are exposed and form a portion of an outer surface of the hub 500 and the sleeve portions 560, 580 also form portions of the outer surface of the hub 500.

The monolithic body portion 510 comprises a plurality of fins 520 extending between the inner tube 513 and the outer body 517. Each of the fins 520 extends along the length of the monolithic body portion 510 from a position that is at or adjacent to the first end 511 to a position that is at or adjacent to the second end 512 to provide the monolithic body portion 510 with the desired structural integrity. In the exemplified embodiment, each of the fins 520 is arcuate shaped, but the invention is not to be so limited and the fins 520 may be flat or planar in other embodiments. Each of the fins 520 extends radially from the outer surface 515 of the inner tube 513 to the inner surface 518 of the outer body 517 thereby forming a unitary structure. The fins 520 are circumferentially spaced apart thereby forming a plurality of passageways through the monolithic body portion 510 from the first end 511 to the second end 512 that are external to the bore 516. In an alternative embodiment, the monolithic body portion 510 could be a solid body having no passageways other than the bore 516. In such an embodiment, the inner tube 513 and outer body 517 would form a single, solid, unitary structure without any gaps, spaces, or passageways therebetween.

The monolithic body portion 510 comprises an annular groove 521 located between the first and second ends 511, 512. In the exemplified embodiment, the annular groove 521 is located equidistant from the first and second ends 511, 512 of the monolithic body portion 510. The annular groove 521 is a depression or recess that is formed into the outer surface 519 of the outer body 517 (which is also the outer surface of the monolithic body portion 510 and the outer surface of the hub 500). The annular groove 521 surrounds the longitudinal axis $A_H$-$A_H$.

The annular groove 521 extends from a first end 522 to a second end 523 in the direction of the longitudinal axis $A_H$-$A_H$. The annular groove 521 has a length $L_G$ measured between the first and second ends 522, 523. Furthermore, in the exemplified embodiment, the annular groove 521 has a constant radius of curvature from the first end 522 to the second end 523. In the exemplified embodiment, the radius of curvature is in the range of 0.6 and 0.8 inches, more specifically 0.65 and 0.75 inches, and more specifically 0.68 and 0.72 inches. As noted above, the elongated bar 600 (which is shown in phantom in FIG. 22) has a diameter between 1.0 inch and 1.5 inches, and more specifically approximately 1.25. In some embodiments, a ratio of the radius of curvature of the annular groove 521 to the radius of the elongated bar 600 may be between 1.05:1 and 1.6:1, more specifically between 1.05:1 and 1.3:1, and still more specifically between 1.05:1 and 1.15:1. In some embodiments, the ratio of the radius of curvature of the annular groove 521 to the radius of the elongated bar 600 may be greater than 1:1 and less than 1.5:1, less than 1.4:1, less than 1.3:1, or less than 1.2:1. This ensures that when the elongated bar 600 is positioned within the annular groove 521 (as shown in FIG. 14 and in phantom in FIG. 22), the elongated bar 600 is not able to move much, if at all, in the direction of the longitudinal axis $A_H$-$A_H$ of the hub 500.

The hub 500 may have a length measured from the first end 501 to the second end 502 of approximately 7 to 8 inches. Thus, when the elongated bar 600 (which has a length greater than 30 inches), or even just the center component 610 thereof (which has a length greater than 10 inches, and more specifically greater than 15 inches), is positioned within the bore 516, portions of the elongated bar 600 or the center component 610 thereof will protrude from both of the first and second ends 501, 502 of the hub 500 (because the center component 610 and the elongated bar 600 in its assembled state are both longer than the length of the hub 500). Furthermore, the bore 516 may have a diameter between 1 inch and 2 inches, more specifically between 1.2 inches and 1.6 inches, and still more specifically approximately 1.4 inches. In some embodiments, the diameter of the bore 516 is larger than the diameter of the elongated bar 600. For example, a ratio of the diameter of the bore 516 to a diameter of the elongated bar 600 may be in a range of 1.05:1 and 1.2:1, or it may be greater than 1.05:1 or greater than 1.1:1, to ensure that there is clearance between the elongated bar 600 and the inner surface 514 of the inner tube 513 when the elongated bar 600 is positioned within the bore 516 (as shown in phantom in FIG. 22). This enables the elongated bar 600 to be readily inserted into and removed from the bore 516 without difficulty for seamless transition between exercises.

The monolithic body portion 510 of the hub 500 comprises a first axial portion 524 located between the first end 511 of the monolithic body portion 510 and the first and 522 of the annular groove 521 and a second axial portion 525 located between the second end 512 of the monolithic body portion 510 and the second end 523 of the annular groove 521. The first axial portion 524 has a length $L_{AP1}$ and the second axial portion 525 has a length $L_{AP2}$. The lengths $L_{AP1}$, $L_{AP2}$ may be between 2 inches and 4 inches, more specifically between 2.5 inches and 3.5 inches, and more specifically between 2.8 inches and 3.4 inches. Regardless of the exact lengths, the lengths $L_{AP1}$ and $L_{AP2}$ may be greater than the length $L_G$ of the annular groove 521. In some embodiments, a ratio of the length $L_{AP1}$, $L_{AP2}$ of the first and second axial portions 524, 525 to the length $L_G$ of the annular groove 521 may be between 1.5:1 and 3.5:1, more specifically between 2:1 and 3:1, still more specifically between 2.5:1 and 3:1, and even more specifically approximately 2.75:1.

The first axial portion 524 comprises a second portion 526 that is exposed and a first portion 527 that is covered by the first sleeve portion 560. The second axial portion 526 comprises a second portion 528 that is exposed and a first portion 529 that is covered by the second sleeve portion 580. The first portion 527 of the first axial portion 524 of the monolithic body portion 510 includes the first end 511 of the monolithic body portion 510 and the first portion 529 of the second axial portion 525 of the monolithic body portion 510 includes the second end 512 of the monolithic body portion 510. The second portion 526 of the first axial portion 524 is located between the first portion 527 of the first axial portion 524 and the annular groove 521 and the second portion 528 of the second axial portion 525 is located between the first portion 529 of the second axial portion 525 and the annular groove 521. The first portion 526 of the first axial portion 524 of the monolithic body portion 510 and the first sleeve portion 560 collectively form a first end portion 530 of the hub 500. The first portion 528 of the second axial portion 525 of the monolithic body portion 510 and the second sleeve portion 580 collectively form a second end portion 531 of the hub 500.

Figure 22:
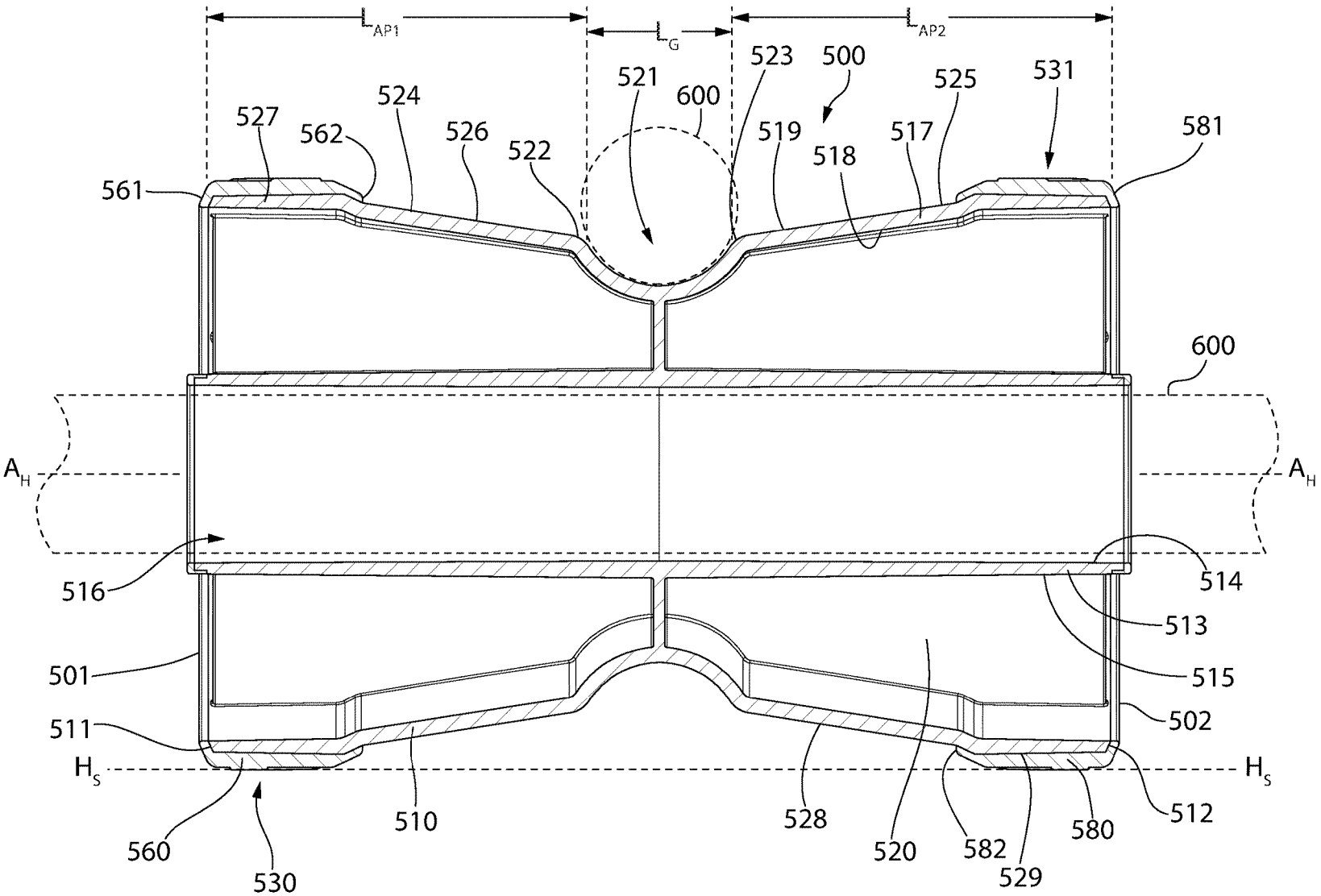
FIG. 22 is a cross-sectional view taken along line XXII-XXII of FIG. 20, with phantom lines used to illustrate different ways that the elongated bar can interact with the hub.

The first sleeve portion 560 wraps around an entire circumference of the monolithic body portion 510 along the first portion 527 of the first axial portion 524 and the second sleeve portion 580 wraps around an entire circumference of the monolithic body portion 510 along the first portion 529 of the second axial portion 525. In the exemplified embodiment, the first end portion 530 is no more than one-half of the length $L_{AP1}$ of the first axial portion 524 and the second end portion 531 is no more than one-half of the length $L_{AP2}$ of the second axial portion 525. In total, less than half of the outer surface of the monolithic body portion 510 is covered by the first and second sleeve portions 560, 580. Of course, the first and second end portions 530, 531 may take up more than one-half of the lengths $L_{AP1}$, $L_{AP2}$ in other embodiments. In the exemplified embodiment, the first sleeve portion 560 also covers a perimeter portion of the first end 511 of the monolithic body 510 and the second sleeve portion 580 covers a perimeter portion of the second end 512 of the monolithic body 510. Stated another way, the first sleeve portion 560 covers the portion of the first end 511 that is formed by the outer body 517 and the second sleeve portion 580 covers the portion of the second end 511 that is formed by the outer body 517. An additional resilient material (i.e., thermoplastic elastomer or the like) may also be positioned on the portion of the first and second ends 511, 512 that is formed by the inner tube 513, as best shown in FIG. 22.

The resilient material (including the sleeve portions 560, 580 and any others such as that which is placed on the ends of the inner tube 513) may have a color contrast with the monolithic body portion 510 to enhance the aesthetics of the hub 500. Thus, the monolithic body portion 510 may be a dark color such as gray, black, or the like and the resilient material may be a bright color such as orange, green, or the like. The outer surface of the monolithic body portion 510 may also include indicium such as manufacturer information, branding, use instructions, or the like.

The first sleeve 560 extends from a first end 561 that forms a portion of the first end 501 of the hub 500 to a second end 562. The second sleeve 580 extends from a first end 581 that forms a portion of the second end 502 of the hub 500 to a second end 582. In the exemplified embodiment, the monolithic body 510 has a non-constant diameter from the annular groove 521 to the first and second ends 511, 512. Specifically, the diameter of the monolithic body 511 continuously increases from the annular groove 521 to the second end 562 of the first sleeve 560 (or from the annular groove 521 to the first portion 527 of the first axial portion 524). Similarly, the diameter of the monolithic body 511 continuously increases from the annular groove 521 to the second end 582 of the second sleeve 580 (or from the annular groove 521 to the first portion 529 of the second axial portion 525). This occurs due to the outer body 517 being inclined relative to the longitudinal axis $A_H$-$A_H$ extending in both directions away from the annular groove 521. Thus, the monolithic body portion 510 of the hub 500 has a generally bowtie-like or hourglass-like shape in the exemplified embodiment.

Due to the changing diameter as described above and shown in the drawings and the addition of the sleeve portions 560, 580 to the monolithic body portion 510, the outer diameter of the monolithic body portion 510 is at its peak or greatest along the first and second end portions 530, 531 where the sleeve portions 560, 580 cover the monolithic body portion 510. As a result, when the hub 500 is placed on a horizontal surface $H_S$-$H_S$ with the longitudinal axis $A_H$-$A_H$ parallel to the horizontal surface $H_S$-$H_S$, only the first and second end portions 530, 531, and more specifically the sleeve portions 560, 580 thereof, will contact the horizontal surface $H_S$-$H_S$. This is desirable because the sleeve portions 560, 580 are formed from a resilient material so they will enable the part of the hub 500 that contacts the ground or other horizontal surface to flex in response to any bumps, protrusions, or unevenness on the horizontal surface to allow for a smooth rolling movement of the hub 500 along the horizontal surface. The maximum diameter of the hub 500 may be between 4.5 inches and 5 inches in some embodiments.

Referring to FIGS. 14, 23, and 24, different uses of the exercise kit 2000 will be described. As described above, the elongated bar 600 is configured to interact with the hub 500 in multiple positions to enable a user to perform difference exercises. FIG. 14 illustrates one such exercise position wherein the elongated bar 600 is positioned within the annular groove 521 of the hub 500. In this position, the elongated bar 600 can pivot about an axis that extends through the hub 500 and is perpendicular to the longitudinal axis $A_H$-$A_H$ of the hub 500. The elongated bar 600 can also move side-to-side along its longitudinal axis $A_B$-$A_B$ while portions of the elongated bar 600 remain positioned within the annular groove 521. Specifically, as the elongated bar 600 moves side-to-side while a portion of the elongated bar 600 remains positioned in the annular groove 521, the hub 500 will roll or rotate about its longitudinal axis along the horizontal surface upon which is it positioned. A user can get into a push-up type position with his/her hands on the elongated bar 600 and pivot the elongated bar 600 and/or move the elongated bar 600 side-to-side to perform various exercises. The user can perform various exercises for the core and other muscle groups in this position.

Referring to FIG. 23, another exercise position is depicted wherein the elongated bar 600 is positioned within the bore 516 of the hub 500. In FIG. 23, the elongated bar 600 is fully assembled with the first and second end components 620, 630 coupled to the center component 610. Because the elongated bar 600 has a greater length than the hub 500, portions of the elongated bar 600, including the entirety of the first and second end components 620, 630, protrude from or are located external to the bore 516. FIG. 24 illustrates another exercise position that is similar to the one depicted in FIG. 23 except that in this position only the central component 610 of the elongated bar 600 is positioned within the bore 516 and the first and second end components 620, 630 are not coupled to the central component 610. Because the central component 610 is also longer than the hub 500, positions of the central component 610 protrude from the first and second ends 501, 502 of the hub 500. In the exercise positions of FIGS. 23 and 24, a user can get into a push-up position and move the elongated bar 600 and hub 500 away from and towards the user. The user can perform various exercises for the core and other muscle groups in this position.

For ease of use, in the exemplified embodiment the elongated bar 600 is never locked relative to the hub 500. Thus, when the elongated bar 600 is positioned within the bore 516, the elongated bar 600 remains slidable in the direction of the longitudinal axis $A_B$-$A_B$ of the elongated bar 600. Furthermore, when the elongated bar 600 is positioned within the annular groove 521, the elongated bar 600 is also moveable/slidable in the direction of the longitudinal axis $A_B$-$A_B$ of the elongated bar 600. Thus, a user can readily transition from the various exercise positions without having to unlock the elongated bar 600 before making such transitions. Furthermore, even during use a user can slide the elongated bar 600 relative to the hub 500 in the direction of the axis $A_B$-$A_B$ of the elongated bar 600, which can enhance the workout achieved by the user. To describe this another way, the elongated bar 600 is in no way physically coupled to the hub 500 when it is in the bore 516 or when it is in the annular groove 521. There is no mechanism or structure, whether a part of the elongated bar 600 or hub 500 or a separate component, that fixes the elongated bar 600 to the hub 500. Rather, the elongated bar 600 merely rests within the bore 516 or along the annular groove 521 while a user performs various exercises during a workout regimen. Of course, in alternative embodiments structures and/or components could be provided to enable a user to lock the elongated bar 600 within the bore 516 and/or the annular groove 521 if so desired.

Figure 25A:
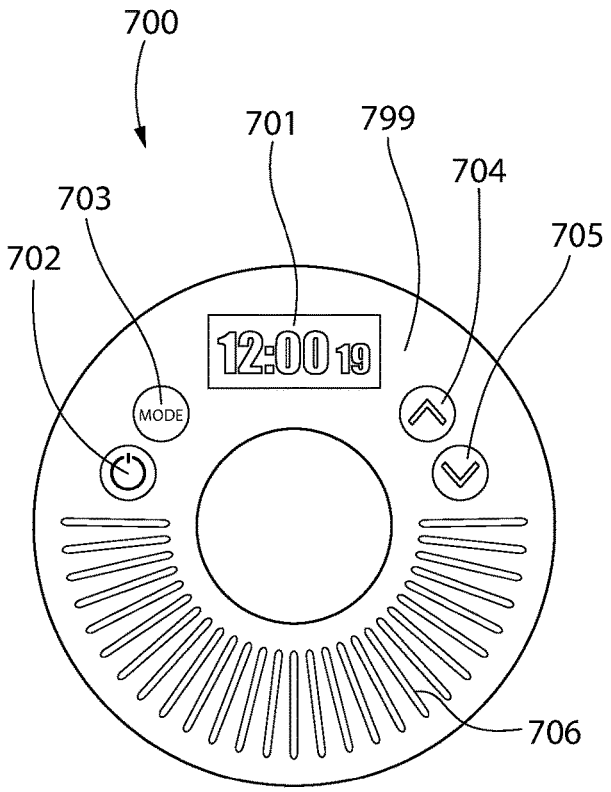
FIG. 25A is a front view of an accessory unit that can be coupled to the hub.
Figure 25B:
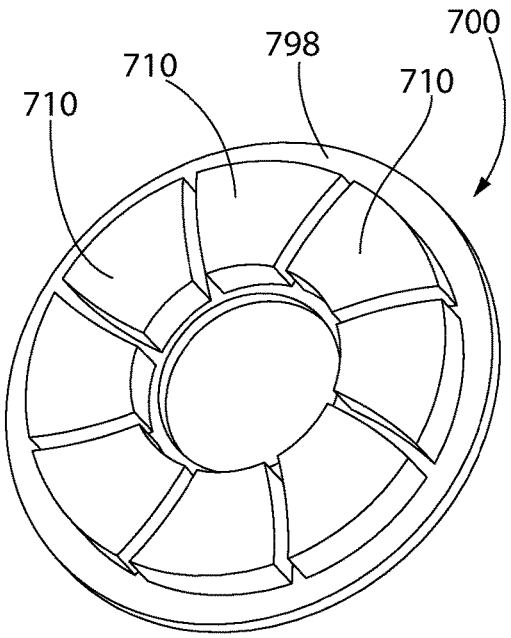
FIG. 25B is a rear perspective view of the accessory unit of FIG. 25A.
Figure 26A:
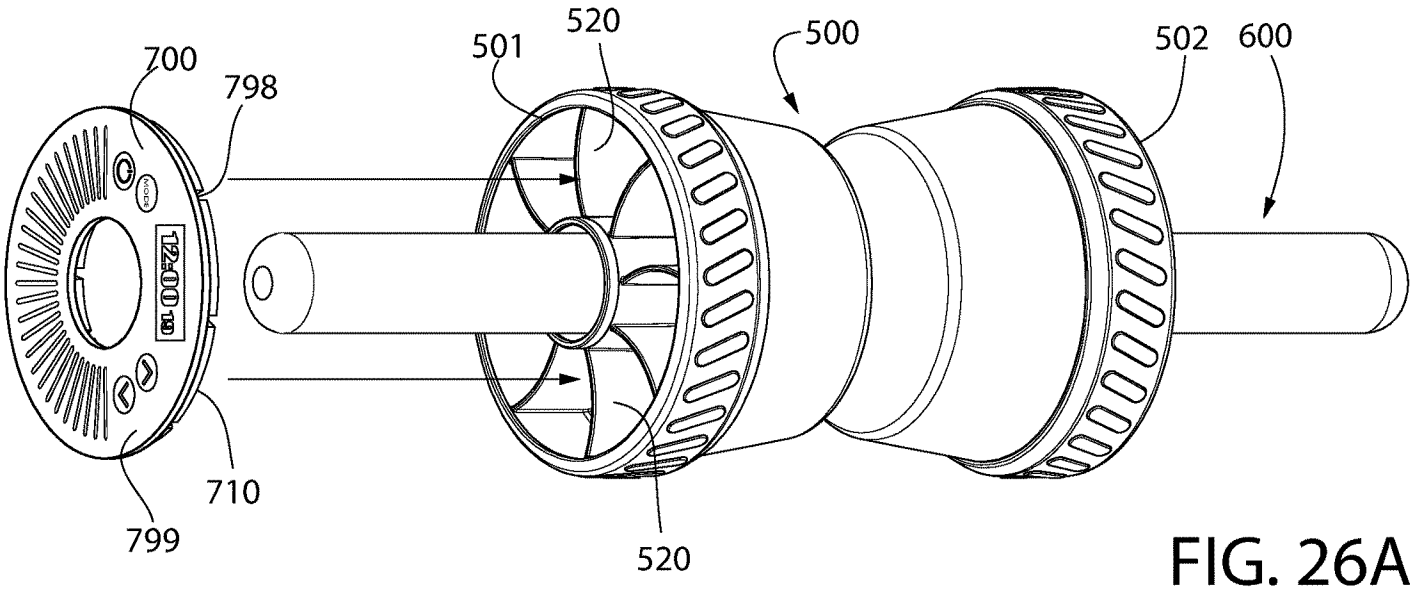
FIGS. 26A and 26B illustrate the manner in which the accessory unit of FIG. 25A can be attached to the hub of FIG. 19.
Figure 26B:
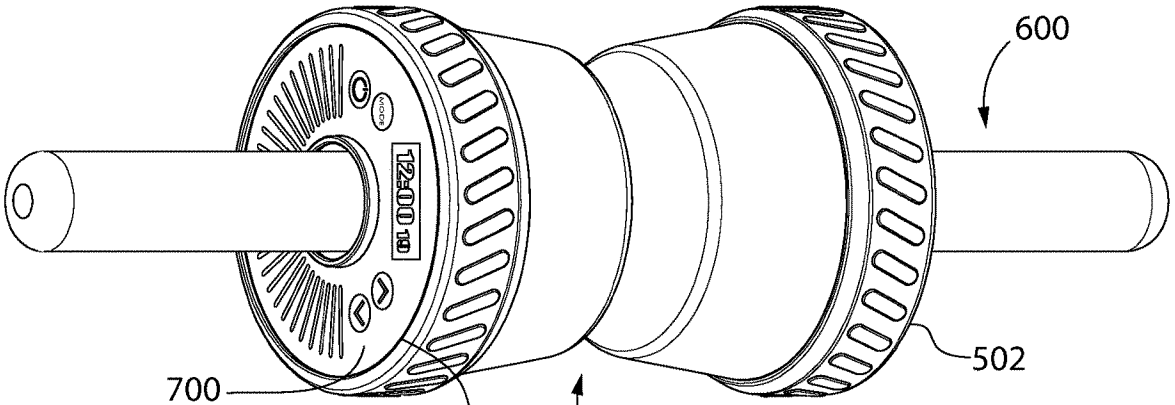

Referring to FIGS. 25A and 25B, an accessory unit 700 is illustrated in accordance with an embodiment of the present invention. The accessory unit 700 may be detachably coupled to the hub 500, as shown in FIGS. 26A and 26B described below, to enhance a user's workout experience when using the exercise kit 2000. Thus, the accessory unit 700 may form a part of the exercise kit 2000 and the accessory unit 700 may be sold with the hub 500 and the elongated bar 600 or it may be sold separately as an add-on component. The accessory unit 700 may be configured to provide feedback and information to a user to enhance the workout experience without compromising the core exercises that are provided by the exercise system 2000.

In one embodiment, the accessory unit 700 may be a two-part injection molded clam shell style housing having a front surface 799 and a rear surface 798. The front surface 799 may have a display 701 (such as an LED display), control interface including a power button 702, mode button 703, and up and down arrows 704, 705, and a speaker 706. The accessory unit 700 may also include replaceable batteries. The display 701 may display a timer so that a user can time his/her workout, a clock, or any other feature desired to be shown on the display 701. The speaker 706 may transmit pre-recorded sounds including music, inspirational phrases, or the like. The speaker 706 may also play non pre-recorded sounds such as by streaming music or the like. In some embodiments, the accessory unit 700 may include Wi-Fi or Bluetooth connectivity so that it can be electronically paired with a smart phone, tablet, smart watch, or the like. The accessory unit 700 may be able to play music, time a workout, provide workout instructions including instructing a user to transition between different exercises, track a user's workout to determine if the user is meeting goals and/or improving over time, interact with the user's external electronic device (phone, table, watch, etc.) to enable the user to store workout data on the external electronic device, etc. In some embodiments, the accessory unit 700 may be considered a smart attachment, a smart hub, a smart accessory, a smart pack, or the like.

The accessory unit 700 comprises a plurality of connection protuberances 710 protruding from the rear surface 798. The connection protuberances 710 are configured to fit within the spaces between the fins 520 of the hub 500 to couple the accessory unit 700 to the hub 500. Specifically, referring to FIGS. 26A and 26B, the accessory unit 700 can be pressed into engagement with either of the first or second ends 501, 502 of the hub 500 until the connection protuberances 710 enter into the spaces between the fins 520. The engagement between the fins 520 and the connection protuberances 710 may securely retain the accessory unit 700 coupled to the hub 500. Of course, other connection techniques may be used including external hardware such as screws, bolts, fasteners, or the like. In still other embodiments, the accessory unit 710 may form a permanent part of the hub 500.

Figure 27A:
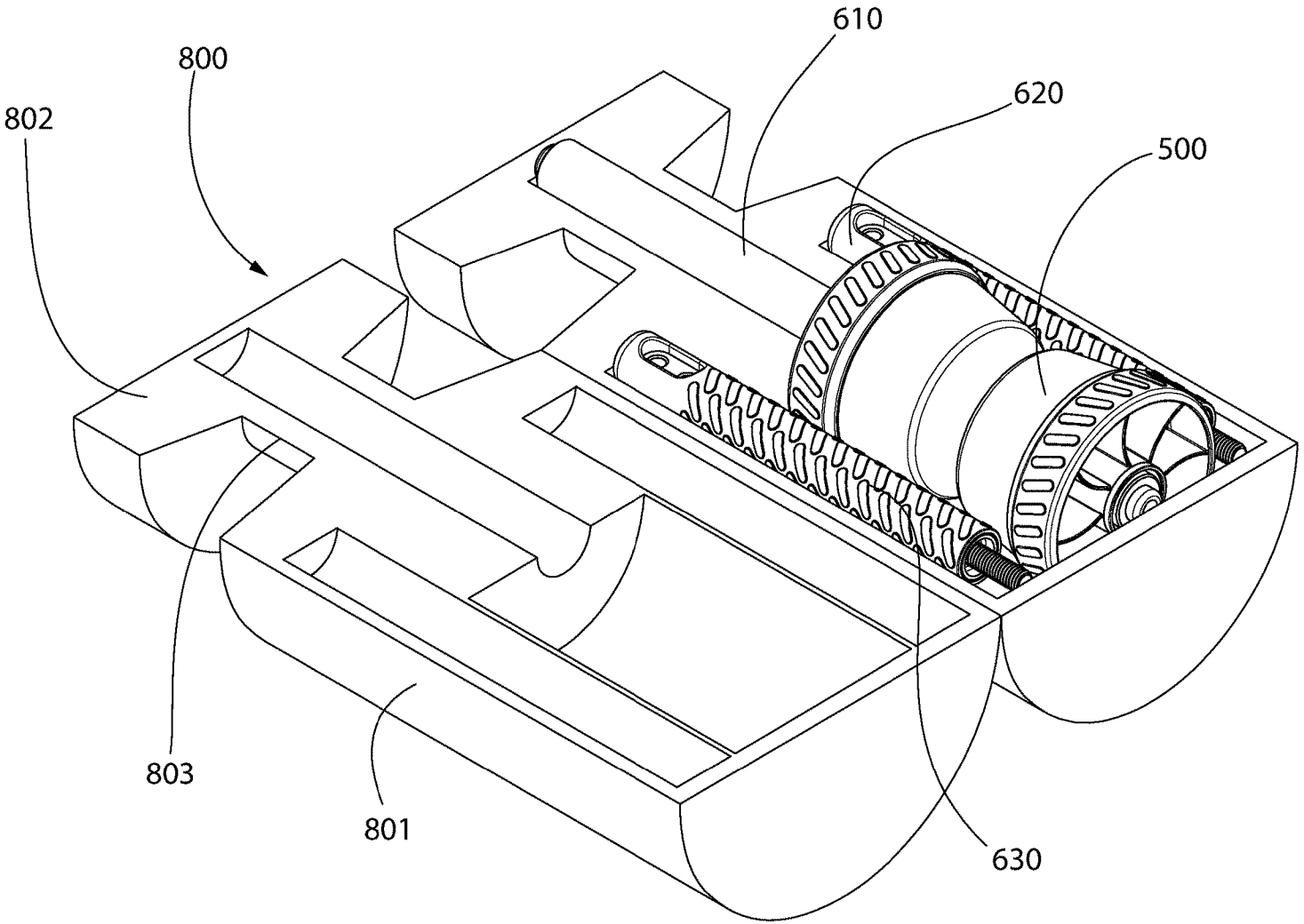
FIG. 27A illustrates the kit positioned within a case for portability with the case in a open state.
Figure 27B:
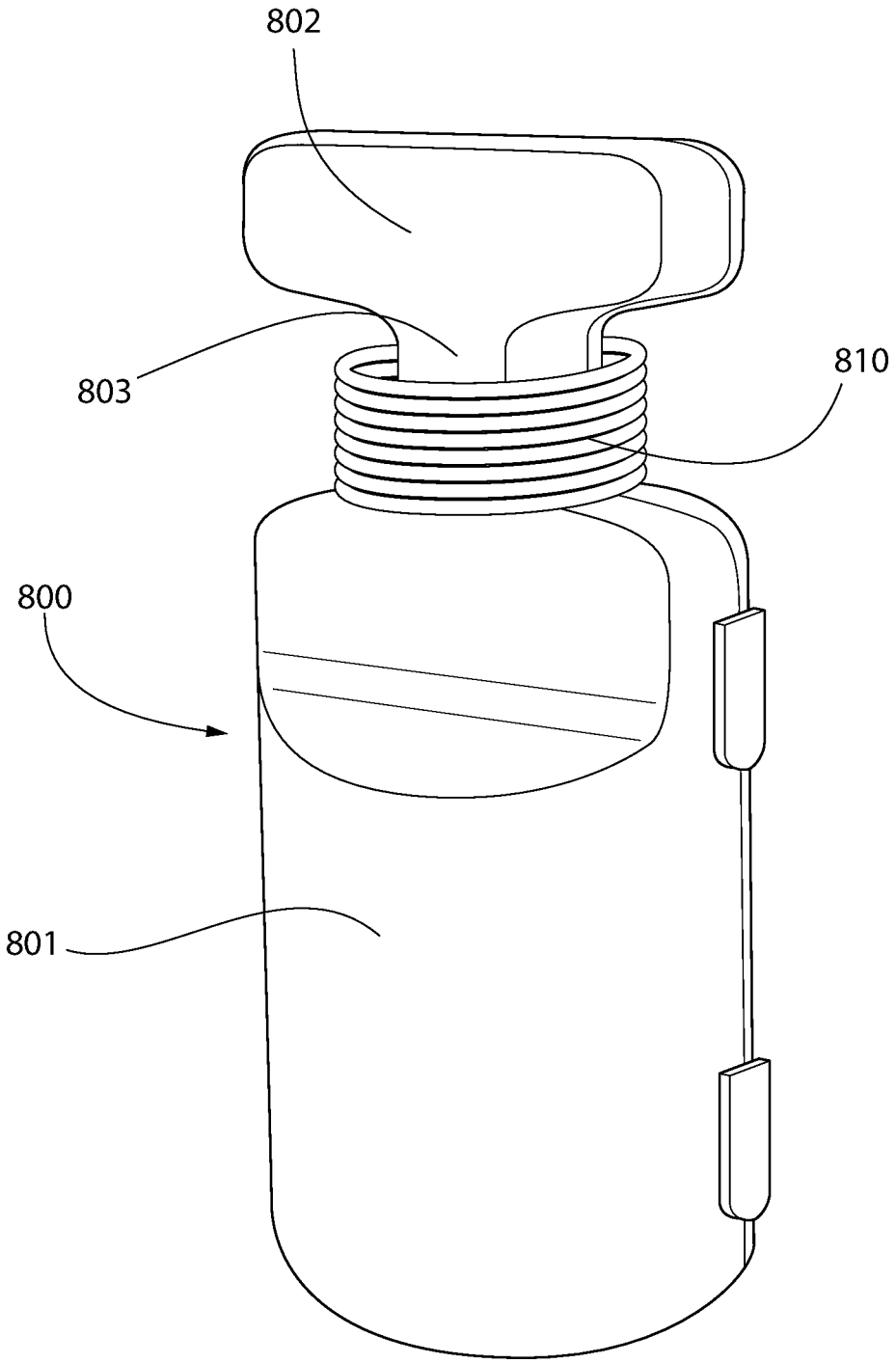
FIG. 27B illustrates the case in a closed state with resistance bands coupled to an outer surface of the case.

Referring to FIGS. 27A and 27B, a case 800 for storing the exercise kit 2000 is illustrated in accordance with an embodiment of the present invention. The case 800 comprises various recesses, depressions, compartments, or the like to sufficiently hold the hub 500 and each of the components of the elongated bar 600 in a disassembled state. The elongated bar 600 is preferably stored in the disassembled state so that it takes up less space during such storage and transport. The case 800 may be formed of an desired material, preferably a hard plastic but could also be metal or the like.

FIG. 27B illustrates the case 800 in a closed state. The case 800 includes a main body portion 801, a handle portion 802, and a neck portion 803 extending between the main body portion 801 and the handle portion 802. The various parts of the exercise kit 2000 may be retained within just the main body portion 801 or within each of the main body, handle, and neck portions 801, 802, 803 as with the exemplified embodiment. Furthermore, one advantage of the shape of the case 800 is that a plurality of resistance bands 810 may be wrapped around the neck portion 803 of the case 800 for storage and transport thereof. This ensures that resistance bands 810 are kept with the other components of the exercise kit 2000 even when the exercise kit 2000 is transported such as during travel.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An exercise kit comprising:

a hub comprising:

a monolithic body portion extending from a first end to a second end along a first longitudinal axis, the monolithic body portion comprising:

an annular groove located between the first and second ends; and a bore extending from the first end to the second end;

an elongated bar extending along a second longitudinal axis and configured to interact with the hub in multiple positions to enable a user to perform different exercises, the multiple positions comprising: (1) a first exercise position wherein the elongated bar is positioned within the bore and portions of the elongated bar protrude from the first and second ends of the monolithic body portion; and (2) a second exercise position wherein the elongated bar is positioned within the annular groove; and wherein the elongated bar is movable relative to the hub in a direction of the second longitudinal axis in both of the first and second exercise positions.

2. The exercise kit according to claim 1 wherein the annular groove has a first length measured in a direction of the longitudinal axis, wherein the monolithic body portion comprises a first axial portion extending between the first end and the annular groove and a second axial portion extending between the second end and the annular groove, the first axial portion having a second length measured in a direction of the longitudinal axis and the second axial portion having a third length measured in a direction of the longitudinal axis, the first length being less than each of the second and third lengths.

3. The exercise kit according to claim 2 wherein the hub further comprises:

a first sleeve portion covering a first portion of the first axial portion of the monolithic body portion to form a first end portion of the hub, a second portion of the first axial portion of the monolithic body portion that is located between the first sleeve portion and the annular groove being exposed; and a second sleeve portion spaced apart from the first sleeve portion and covering a first portion of the second axial portion of the monolithic body portion to form a second end portion of the hub, a second portion of the second axial portion of the monolithic body portion that is located between the second sleeve portion and the annular groove being exposed.

4. The exercise kit according to claim 3 wherein the first end portion of the hub is no more than one-half of the first length and wherein the second end portion of the hub is no more than one-half of the second length.

5. The exercise kit according to claim 3 wherein the monolithic body portion is formed from a rigid material and the first and second sleeve portions are formed from a resilient material.

6. The exercise kit according to claim 3 wherein an outer diameter of the hub is greatest along the first and second end portions so that when the hub is placed on a horizontal surface with the first longitudinal axis parallel to the horizontal surface, only the first and second end portions of the hub are in contact with the horizontal surface.

7. The exercise kit according to claim 3 wherein an outer diameter of the monolithic body portion continuously increases from the annular groove to the first portions of each of the first and second axial portions.

8. The exercise kit according to claim 1 wherein the annular groove has a radius of curvature and the elongated bar has a radius, a ratio of the radius of curvature of the annular groove to a radius of the elongated bar being less than 1.5:1.

9. The exercise kit according to claim 8 wherein the ratio of the radius of curvature of the annular groove to the radius of the elongated bar is less than 1.3:1 and the radius of curvature of the annular groove is constant at all points along the annular groove.

10. The exercise kit according to claim 1 wherein the monolithic body portion comprises an inner tube having an inner surface that defines the bore, an outer body having an outer surface that forms an outer surface of the monolithic body portion, and a plurality of fins extending between the inner tube and the outer body.

11. The exercise kit according to claim 1 wherein the bore has a first diameter and the elongated bar has a second diameter, and wherein a ratio of the first diameter to the second diameter is greater than 1.1:1 to enable the elongated bar to slide within the bore with clearance.

12. The exercise kit according to claim 1 further comprising at least one resistance band configured to be detachably coupled to the elongated bar.

13. The exercise kit according to claim 1 wherein the elongated bar comprises a center component extending from a first end to a second end and having a length measured therebetween, a first end component, and a second end component, wherein the first end component is detachably coupled to the first end of the center component and the second end component is detachably coupled to the second end of the center component, and wherein the length of the center component is greater than a length of the hub measured between first and second ends of the hub.

14. An exercise kit comprising:

a hub comprising:

a monolithic body portion extending from a first end to a second end along a first longitudinal axis, the monolithic body portion formed of a rigid material and comprising:

an annular groove located between the first and second ends; and a bore extending from the first end to the second end; and a first sleeve portion covering a first portion of the monolithic body portion to form a first end portion of the hub and a second sleeve portion spaced apart from the first sleeve portion and covering a second portion of the monolithic body portion to form a second end portion of the hub, the first and second sleeve portions formed of a resilient material; and an elongated bar configured to interact with the hub in multiple positions to enable a user to perform different exercises, the multiple positions comprising: (1) a first exercise position wherein the elongated bar is positioned within the bore; and (2) a second exercise position wherein the elongated bar is positioned within the annular groove.

15. The exercise kit according to claim 14 wherein the hub has a maximum diameter along the first and second end portions so that when the hub is placed on a horizontal surface with the first longitudinal axis parallel to the horizontal surface, only the first and second end portions are in contact with the horizontal surface.

16. The exercise kit according to claim 14 wherein an outer diameter of the monolithic body portion continuously increases from the annular groove to the first portions of each of the first and second axial portions.

17. The exercise kit according to claim 14 wherein a portion of the monolithic body portion located between the first and second sleeve portions is exposed and forms a part of an outer surface of the hub.

18. An exercise kit comprising:

a hub comprising:

a body portion extending from a first end to a second end along a first longitudinal axis, the body portion comprising:

a bore extending from the first end to the second end;

an annular groove having a first length;

a first axial portion extending from the annular groove to the first end and having a second length; and a second axial portion extending from the annular groove to the second end and having a third length, each of the second and third lengths being greater than the first length;

an elongated bar alterable between: (1) a first exercise position wherein the elongated bar is positioned within the bore with portions of the elongated bar protruding from the first and second ends of the body portion; and (2) a second exercise position wherein the elongated bar is positioned within the annular groove.

19. The exercise kit according to claim 18 wherein the annular groove has a radius of curvature and the elongated bar has a radius, a ratio of the radius of curvature of the annular groove to a radius of the elongated bar being less than 1.3:1.

20. The exercise kit according to claim 19 wherein the body portion of the hub is a monolithic structure.

* * * * *